US012396513B2

(12) United States Patent
Clemens et al.

(10) Patent No.: US 12,396,513 B2
(45) Date of Patent: Aug. 26, 2025

(54) ARTICLE OF FOOTWEAR WITH INTEGRALLY-KNITTED UPPER AND SOLE INCLUDING GRIP YARN AND METHOD OF MANUFACTURING

(71) Applicant: NIKE, Inc., Beaverton, OR (US)

(72) Inventors: Alexander S. Clemens, Beverly, MA (US); Michael C. Gorski, Portland, OR (US); Eric Y. Lee, Portland, OR (US); Andreas I. Schoppel, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/522,538

(22) Filed: Nov. 29, 2023

(65) Prior Publication Data

US 2024/0180289 A1 Jun. 6, 2024

Related U.S. Application Data

(60) Provisional application No. 63/429,211, filed on Dec. 1, 2022.

(51) Int. Cl.

| | |
|---|---|
| ***A43B 1/04*** | (2022.01) |
| ***A43B 23/02*** | (2006.01) |
| ***A43B 23/26*** | (2006.01) |

(52) U.S. Cl.

CPC ..... *A43B 1/04* (2013.01); *A43B 23/0215* (2013.01); *A43B 23/0245* (2013.01); *A43B 23/26* (2013.01)

(58) Field of Classification Search

CPC .... A43B 1/04; A43B 3/10; A43B 3/14; A43B 3/30

See application file for complete search history.

(56) References Cited

U.S. PATENT DOCUMENTS

| | | | | | |
|---|---|---|---|---|---|
| 2,919,503 | A | * | 1/1960 | Sholovitz | A43D 113/00 D2/900 |
| 3,681,860 | A | * | 8/1972 | Bidegain | A43B 3/30 36/138 |
| D274,291 | S | * | 6/1984 | Migdow | D2/900 |
| D274,672 | S | * | 7/1984 | Garrett | D2/943 |
| 4,785,558 | A | * | 11/1988 | Shiomura | A43B 23/025 66/196 |
| 4,976,050 | A | * | 12/1990 | Houghteling | A43B 3/30 36/11 |

(Continued)

FOREIGN PATENT DOCUMENTS

| | | | | |
|---|---|---|---|---|
| CA | 2737206 | A1 * | 10/2012 | A43B 1/04 |
| EP | 3412813 | A1 | 12/2018 | |

(Continued)

*Primary Examiner* — Megan E Lynch

(74) *Attorney, Agent, or Firm* — Quinn IP Law

(57) ABSTRACT

An article of footwear includes an integrally-knitted footwear upper and sole, the sole including reflowed polymeric material of a grip yarn. The ground contact surface of the sole may include the reflowed polymeric material. The footwear upper and the sole are a one-piece, unitary knit construction. A method of manufacturing an article of footwear includes integrally knitting a footwear upper and a sole of an article of footwear, the sole including a grip yarn. The method further includes thermoforming the grip yarn such that the sole includes reflowed polymeric material of the grip yarn.

20 Claims, 22 Drawing Sheets

(56) References Cited

U.S. PATENT DOCUMENTS 5,604,997 A * 2/1997 Dieter ..... A43B 23/042 36/47
5,855,125 A * 1/1999 Lohmueller ..... D06C 11/00 28/162
6,308,438 B1 * 10/2001 Throneburg ..... A43B 3/14 36/26
6,770,581 B1 * 8/2004 DeMott ..... D06N 7/0065 428/96
6,973,742 B2 * 12/2005 Gordon ..... A43B 3/163 36/2.6
9,044,063 B2 * 6/2015 Loverin ..... A43B 3/30
9,545,128 B2 * 1/2017 Podhajny ..... A43B 1/04
10,378,130 B2 8/2019 Dua et al.
10,669,656 B2 6/2020 Green et al.
10,716,356 B2 7/2020 Bell et al.
11,272,745 B2 3/2022 Gazit et al.
2005/0022563 A1 * 2/2005 Keller ..... D04B 21/04 66/194
2006/0096129 A1 * 5/2006 Kaplan ..... A43B 1/0072 36/8.4
2007/0044286 A1 * 3/2007 Nohara ..... D06C 27/00 26/8 R
2008/0110049 A1 5/2008 Sokolowski et al.
2009/0317584 A1 * 12/2009 Ivanoff ..... D03D 15/37 428/95
2010/0071232 A1 * 3/2010 Steele ..... A43B 13/188 36/82
2012/0079742 A1 * 4/2012 Ferreira ..... A43C 11/004 36/54
2013/0305566 A1 * 11/2013 Loverin ..... A43B 3/30 36/102
2014/0237861 A1 * 8/2014 Podhajny ..... A43B 1/04 66/170
2015/0216256 A1 * 8/2015 Podhajny ..... A43B 1/04 12/142 R
2016/0090670 A1 * 3/2016 Meir ..... A43B 23/0205 66/190
2017/0241050 A1 * 8/2017 Zorn ..... D03D 15/58
2018/0002839 A1 * 1/2018 Liao ..... D03D 1/00
2018/0132558 A1 * 5/2018 Berrian ..... D04B 1/102
2018/0289099 A1 10/2018 Bell et al.
2018/0317592 A1 * 11/2018 Rudolf ..... A43B 13/125
2018/0343954 A1 * 12/2018 Li ..... D04B 1/108
2019/0037959 A1 * 2/2019 Berrian ..... A43B 23/081
2019/0231030 A1 8/2019 Uesato
2019/0309452 A1 * 10/2019 Liao ..... D04B 1/18
2019/0328075 A1 10/2019 Poulsen et al.
2020/0046074 A1 2/2020 Berrian et al.
2020/0141035 A1 5/2020 McFarland, II et al.
2020/0214393 A1 * 7/2020 Chang ..... A43B 23/0255
2020/0240054 A1 7/2020 Schoppel et al.
2021/0030117 A1 * 2/2021 Frazier ..... A43B 23/0225
2021/0227920 A1 7/2021 Stein et al.
2022/0007782 A2 1/2022 Frazier et al.
2022/0098767 A1 3/2022 Brinkman et al.
2022/0202105 A1 6/2022 Murrietta et al.
2022/0228303 A1 7/2022 Cox et al.
2023/0263264 A1 * 8/2023 Denk ..... A43B 7/34 2/69.5
2023/0276893 A1 * 9/2023 Mittal ..... A43B 13/141 36/97

FOREIGN PATENT DOCUMENTS

EP 3756499 A1 * 12/2020 ..... A43B 1/04
FR 2002861 A1 * 10/1969
FR 3046915 B1 * 8/2019
TW 201903235 A 1/2019
WO 2018089639 A1 5/2018

* cited by examiner

ARTICLE OF FOOTWEAR WITH INTEGRALLY-KNITTED UPPER AND SOLE INCLUDING GRIP YARN AND METHOD OF MANUFACTURING

CROSS-REFERENCE TO RELATED APPLICATIONS

This application claims the benefit of priority to U.S. Provisional Application No. 63/429,211, filed Dec. 1, 2022, which is hereby incorporated by reference in its entirety.

TECHNICAL FIELD

The present disclosure generally relates to an article of footwear that includes an integrally-knitted footwear upper and sole, the sole including a grip yarn, and to a method of manufacturing the article of footwear.

BACKGROUND

Footwear typically includes a sole configured to be located under a wearer's foot and an upper attached to the sole. The upper typically surrounds the sides and top of the foot. The sole is often several layers, including an insole, a midsole and an outsole, and typically functions to provide cushioning and impact protection. Donning footwear may be difficult for some wearers, such as those with limited dexterity and young children.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
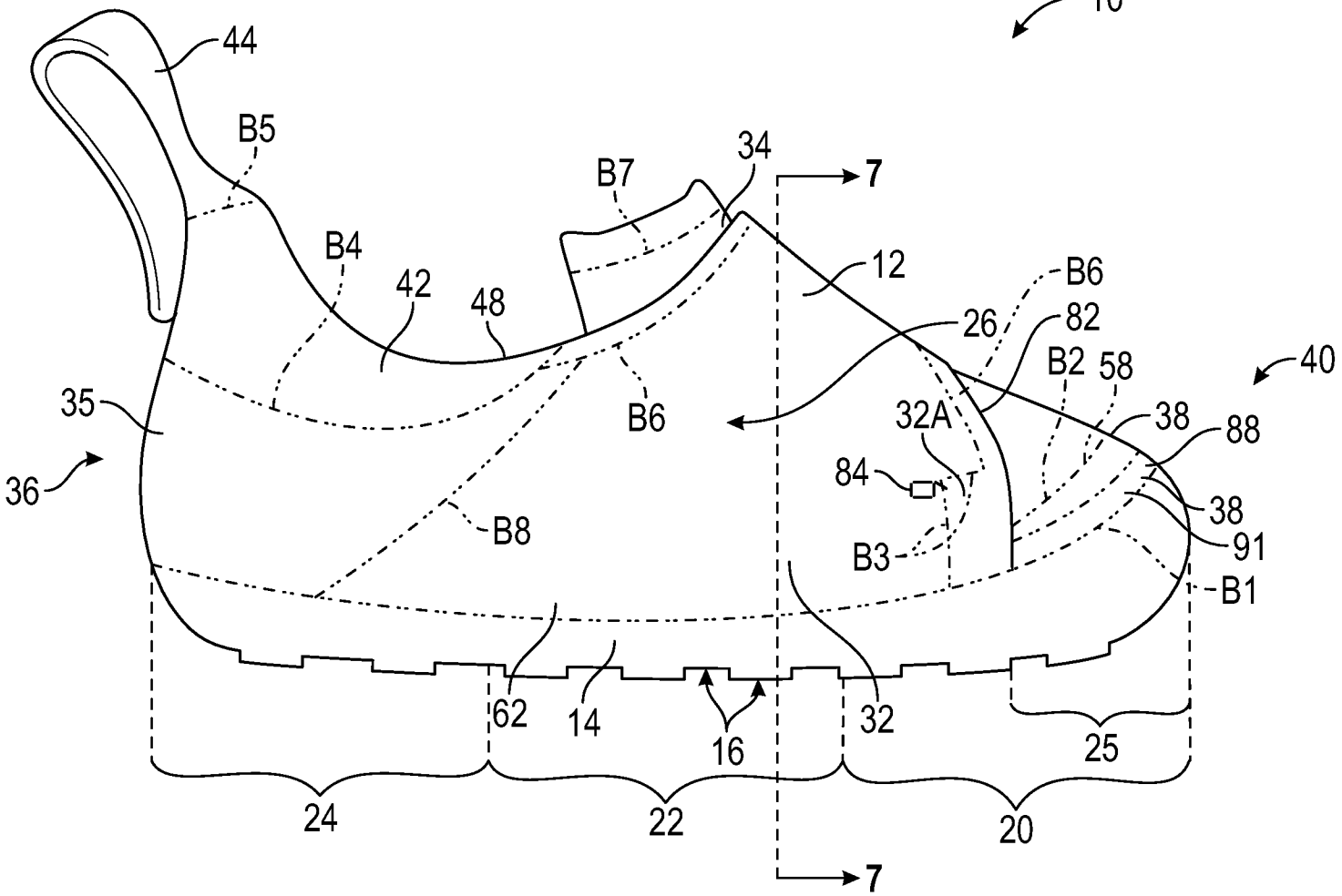
FIG. 1 is a lateral side view of an article footwear within the scope of the present disclosure.

Articles of footwear disclosed herein provide a simplified construction with an integrally-knitted upper and sole (i.e., a knit upper and a knit sole that are knitted together). The sole is relatively thin to enable the wearer's foot to feel the ground underneath the sole to a greater extent than would a traditional sole structure that includes a foam midsole, for example. Integrating grip yarns below the foot enables the sole to provide both the footbed and the traction and durability functions of an outsole while eliminating the need for a typical midsole and insole. Although the article of footwear may be implemented in all sizes, this may aid early development and walking for toddlers. Additionally, the knit construction may advance sustainability initiatives as waste and post processing are minimal. The article of footwear may be especially useful for toddlers, young children, and those with limited dexterity, as it may enable them to independently don and doff their footwear.

The present disclosure generally relates to an article of footwear that includes an integrally-knitted footwear upper and sole, the sole including reflowed polymeric material of a grip yarn. For example, the ground contact surface of the sole may include the reflowed polymeric material. In an aspect, the footwear upper and the sole are a one-piece, unitary knit construction.

In one example, the grip yarn may include a core and a sheath, and the sheath may include thermoplastic material that reflows (e.g., is thermally processed to at least partially melt, and then subsequently cools and resolidifies) to form the polymeric material that may form at least a portion of the ground contact surface. In some implementations, the sole may include more than one grip yarn, e.g., grip yarns of different materials, and the reflowed polymeric material may be a polymeric composition of the different grip yarns.

In an example, the reflowed polymeric material of the sole may be at an outer layer of the sole, and the sole may further include an inner layer integrally knit with the outer layer. The inner layer may be a different yarn than the grip yarns, and may establish a footbed having a foot contact surface. For example, the yarn of the inner layer may include chenille yarn.

In an aspect, the footwear upper may include a knitted medial quarter at a medial side of the article of footwear, a knitted lateral quarter at a lateral side of the article of footwear, a knitted tongue secured to the knitted medial quarter, and a knitted heel portion extending between the knitted medial quarter and the knitted lateral quarter at a rear of the article of footwear. The sole and the footwear upper may together define a foot-receiving cavity, and the knitted medial quarter, the knitted lateral quarter, the knitted tongue, and the knitted heel portion may together define an ankle opening at the foot-receiving cavity. The knitted lateral quarter may extend to form a strap configured to cross over the knitted tongue and secure at the knitted medial quarter to secure a foot within the foot-receiving cavity.

In an example, an article of footwear disclosed herein comprises an integrally-knitted footwear upper including an underfoot portion and defining a foot-receiving cavity above the underfoot portion. The footwear upper includes a knitted medial quarter at a medial side of the article of footwear, a knitted lateral quarter at a lateral side of the article of footwear, a knitted tongue secured to the knitted medial quarter, and a knitted heel portion extending between the knitted medial quarter and the knitted lateral quarter at a rear of the article of footwear. The article of footwear further includes a sole secured to an exterior surface of the underfoot portion. The knitted medial quarter, the knitted lateral quarter, the knitted tongue, and the knitted heel portion together define an ankle opening at the foot-receiving cavity. The knitted lateral quarter extends to form a strap configured to cross over the knitted tongue and secure at the knitted medial quarter to secure a foot within the foot-receiving cavity.

In an implementation, an article of footwear may comprise a knitted component forming one or more of an overfoot portion of the footwear and an underfoot portion of the footwear. The underfoot portion comprises an external facing layer forming ground contacting portions and an internal facing layer forming foot contacting portions. The external facing layer includes a first material comprising a thermoplastic material and the internal facing layer including a second material different from the first material. One or more portions of the external facing layer including the first material have a different coefficient of friction relative to the internal facing layer including the second material.

In an aspect, the one or more portions of the external facing layer have a greater coefficient of friction relative to the internal facing layer including the second material.

In an example, the underfoot portion may include one or more intersection portions at or near a junction of the external facing layer and the internal facing layer that include the first material.

In a further example, the external facing layer may comprise one or more raised traction elements including the first material. The one or more raised traction elements may include reflowed first material.

The external facing layer may comprise one or more interlooped yarns. Each of the one or more interlooped yarns may have a coating of the first material surrounding a core yarn. The core yarn may have a second material that excludes the thermoplastic material and has a greater melting temperature than the first material. In an aspect, the first material may be at least partially fused with one or more core yarns. The internal facing layer may comprise one or more second interlooped yarns comprising the second material. The first material may be at least partially fused to a portion of the one or more second interlooped yarns.

An article of footwear may comprise an integrally-knitted footwear upper and sole. The sole may include one or more interlooped yarns comprising a first material. The first material may include a thermoplastic material.

In an aspect, the sole may include reflowed polymeric material of the thermoplastic material. For example, a ground contact surface of the sole may include the reflowed polymeric material.

In some implementations, at least one of the one or more interlooped yarns includes a core and a sheath, and the sheath includes the thermoplastic material.

In an example, the one or more interlooped yarns comprising the first material is a first yarn, the one or more interlooped yarns include a second yarn comprising a second thermoplastic material, and a ground contact surface of the sole is a polymeric composition of reflowed polymeric material of the first yarn and reflowed polymeric material of the second yarn.

In a further example, the one or more interlooped yarns comprising the first material may be at an outer layer of the sole, and the sole may further include an inner layer integrally knit with the outer layer. The inner layer may include a yarn comprising a different material than the first material and may establish a footbed having a foot contact surface. For example, a ground contact surface of the sole may include reflowed polymeric material of the thermoplastic material, and one or more portions of the of the ground contact surface including the reflowed polymeric material may have a different coefficient of friction relative to the foot contact surface including the yarn of the inner layer. In the same example or in a different example, the yarn of the inner layer establishing the footbed may include two or more twisted core yarns with cut pile yarns between the twisted core yarns.

A method of manufacturing an article of footwear disclosed herein comprises integrally knitting a footwear upper and a sole of an article of footwear, the sole including a grip yarn. The method further includes thermoforming the grip yarn such that the sole includes reflowed polymeric material of the grip yarn. As used herein, "thermoforming" is a thermal process involving heating and shaping a thermoplastic material.

The above features and advantages and other features and advantages of the present teachings are readily apparent from the following detailed description of the modes for carrying out the present teachings when taken in connection with the accompanying drawings. It should be understood that even though in the following Figures embodiments may be separately described, single features thereof may be combined to additional embodiments.

Figure 2:
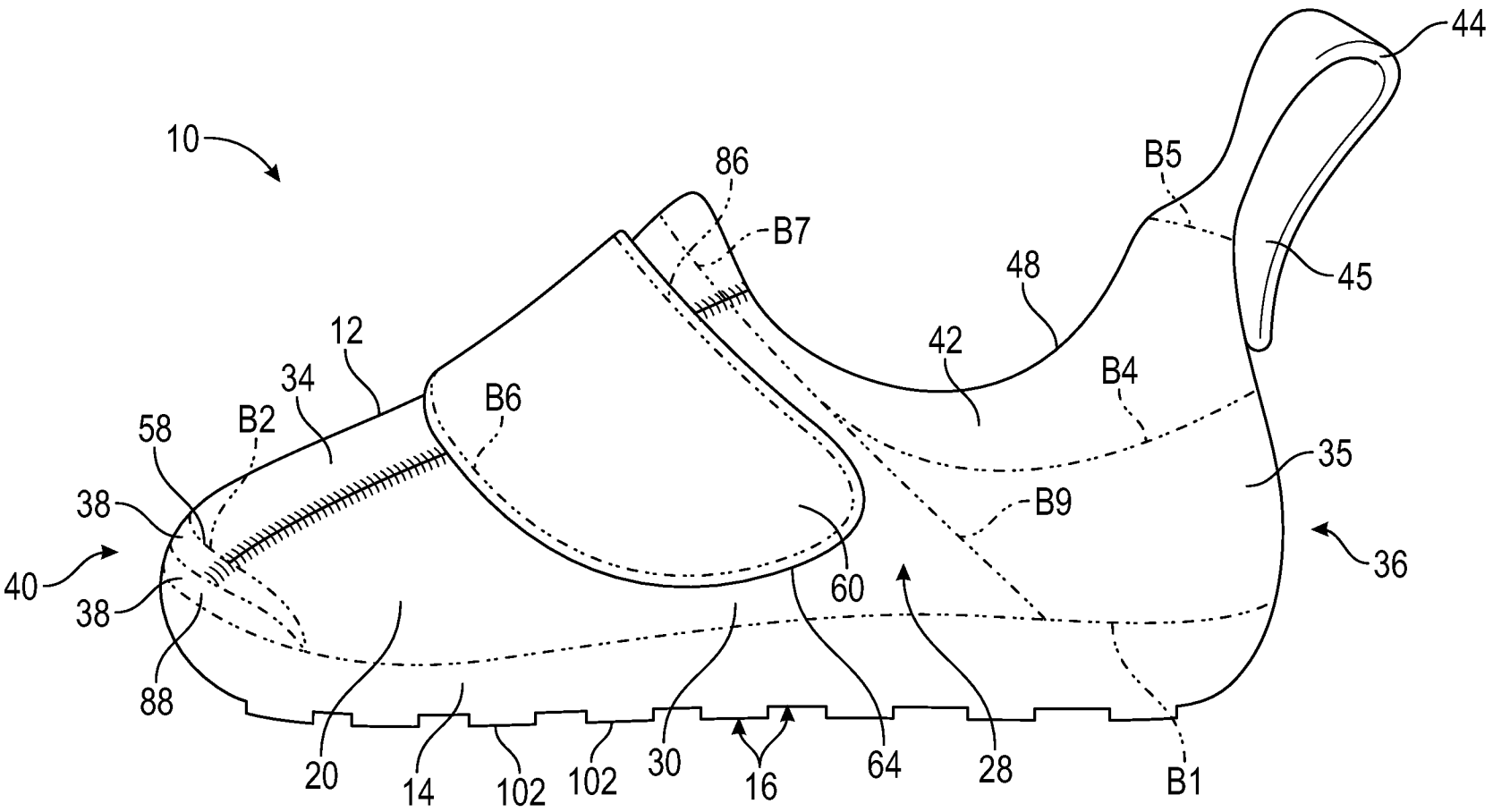
FIG. 2 is a medial side view of the article of footwear of FIG. 1.

Referring to the drawings, wherein like reference numbers refer to like components throughout the views, FIGS. 1 and 2 show an article of footwear 10 that includes an integrally-knitted footwear upper 12 and sole 14. The integrally-knitted footwear upper 12 and sole 14 may be referred to as an upper portion and a sole portion, or as an overfoot portion and an underfoot portion, respectively, of the one-piece article of footwear 10, as they are contiguous and knitted together with one another as a one-piece component. Stated differently, the footwear upper 12 is a knitted construction, the sole 14 is also a knitted construction, and the footwear upper 12 and the sole 14 are knitted together as a one-piece, unitary knit construction. The footwear upper 12 and the sole 14 may be formed as an integral one-piece element during a single knitting process, such as a weft knitting process (e.g., with a flat knitting machine or circular knitting machine), a warp knitting process, or any other suitable knitting process. That is, the knitting process on the knitting machine may substantially form the knit structure of the footwear upper 12 and the sole 14 without the need for additional knitting steps. Alternatively, in other embodiments, two or more portions of the footwear upper 12 and the sole 14 may be formed separately as distinct integral one-piece elements and then the respective elements attached. Accordingly, as utilized herein, an article of footwear is defined as being formed of and having a "unitary knit construction" when formed as a one-piece element through a knitting process. Portions of the knit article of footwear 10 can be joined to each other following the knitting process (e.g., edges of the knitted footwear upper 12 can be joined to one another, as at a seam). In various aspects, other elements (e.g., logos, trademarks, placards) can be added following the knitting process.

Moreover, the knitted sole 14 described herein comprises the entire sole structure of the article of footwear 10, as the article of footwear 10 may be characterized by the absence of any additional sole layers or sole components, such as the absence of a midsole, an insole, a strobel, etc. As such, the knitted sole 14 may comprise both a ground contact surface 16 (e.g., an exterior, exposed, ground-engaging surface, also referred to as ground-contacting portions) and a foot-contact surface 18 (e.g., an interior foot-receiving surface on which the foot rests, also referred to as foot-contacting portions, best shown in FIGS. 4 and 7). The knitted sole 14 is thus multi-functional while maintaining a lightweight and thin construction which may be especially advantageous for developing toddlers. As discussed herein, the knitted sole 14 achieves this multifunctionality in part by utilizing a grip yarn 104, shown best in FIGS. 10-11, and having a ground contact surface 16 of a polymeric composition 112 that includes a reflowed thermoplastic material 106 of the grip yarn 104, best shown in FIG. 12.

With reference to FIG. 1, the article of footwear 10 as well as the upper 12 and the sole 14 may be divided into a forefoot region 20, a midfoot region 22, and a heel region 24. The forefoot region 20 generally includes portions of the article of footwear 10 corresponding with the toes and the metatarsophalangeal joints (which may be referred to as MPT or MPJ joints) connecting the metatarsal bones of the foot and the proximal phalanges of the toes. A forward portion of the forefoot region 20 may thus be referred to as a toe region 25. The midfoot region 22 generally includes portions of the article of footwear 10 corresponding with the arch area and instep of the foot, and the heel region 24 corresponds with rear portions of the foot, including the calcaneus bone. The forefoot region 20, the midfoot region 22, and the heel region 24 are not intended to demarcate precise areas of the article of footwear 10 but are instead intended to represent general areas of the article of footwear 10 to aid in the following discussion.

The article of footwear 10 has a lateral side 26 (indicated in FIG. 1) and a medial side 28 (indicated in FIG. 2). The lateral side 26 and the medial side 28 extend through each of the forefoot region 20, the midfoot region 22, and the heel region 24, and correspond with opposite sides of the article of footwear 10, each falling on an opposite side of a longitudinal midline (LM) of the article of footwear 10, indicated in FIG. 3. The lateral side 26 is thus considered to be opposite from the medial side 28. The article of footwear 10 as shown is configured for a right foot. An article of footwear configured for a left foot may be a mirror image of the article of footwear 10.

The footwear upper 12 includes various portions or zones including a knitted medial quarter 30 at the medial side 28 of the article of footwear 10, a knitted lateral quarter 32 at the lateral side 26 of the article of footwear 10, a knitted tongue 34 secured to the knitted medial quarter 30, a knitted heel portion 35 extending between the knitted medial quarter 30 and the knitted lateral quarter 32 at a rear 36 of the article of footwear 10, a knitted toe box 38 at a front 40 of the article of footwear 10, a knitted collar 42, and a knitted heel pull 44. The knitted heel pull 44 extends integrally from the knitted collar 42. In the embodiment shown, the knitted heel pull 44 is configured as a strap having an end portion 45 secured to the knitted collar 42, such as by stitching, to form a loop. In other embodiments, the knitted heel pull 44 may simply be a tab rather than a loop, or there may be no heel pull. The knitted heel pull 44 may be gripped to help pull the article of footwear 10 over the foot when inserting the foot into the foot-receiving cavity 46.

The various zones or parts of the zones of the footwear upper 12 and of the sole 14 may be knitted of different yarns or different combinations of yarns than one another as discussed herein. In FIGS. 1 and 2, boundaries between portions of the article of footwear 10 that are comprised of different yarns or combinations of yarns than one or more bordering portions are indicated with phantom lines. A boundary B1 is indicated between the sole 14 and the upper 12. A boundary B2 is indicated bordering a top or rear edge of the toe box 38, such as between the tongue 34 and the toe box 38. A boundary B3 is indicated between the yarns in a forward portion of the lateral quarter 32 adjacent to the toe box 38 and yarns of the remainder of the lateral quarter 32. The yarns of the forward portion of the lateral quarter 32 bounded by boundary B3 are near a forward lower edge of the lateral quarter 32 and are contiguous with and may be the same as the yarns of the toe box 38, as discussed herein. A boundary B4 is indicated between the knitted collar 42 and the heel portion 35. A boundary B5 is indicated between the knitted collar 42 and the heel pull 44. A boundary B6 is indicated between the peripheral region of the lateral quarter 32 and strap 60 and the remainder of the lateral quarter 32 and strap 60 as the peripheral region may be of another yarn or yarns than the remainder as discussed herein. A boundary B7 is indicated between a peripheral region at the top of the tongue 34 and the remainder of the tongue 34 as the peripheral region at the top of the tongue 34 may be a different yarn or yarns than the remainder of the tongue 34, as discussed herein. A boundary B8 is indicated between the heel region 35 and the lateral quarter 32. A boundary B9 is indicated between the heel region 35 and the medial lateral quarter 30.

As used herein, the term "yarn" is understood to refer to a long or essentially continuous strand of fibers or filament (s) in a form suitable for knitting. Types of yarns include continuous filament yarns, examples of which include monofilament yarns (consisting of a single continuous filament) and multi-filament yarns (consisting of a plurality of flat or textured filaments which are typically twisted or air-entangled with each other). Spun yarns are another type of yarn, which consist of a plurality of staple fibers (such as cotton or wool fibers) or cut fibers or filaments which are entangled with each other in the spinning process. Complex yarns are yet another type of yarn, which may consist of a cord or cabled yarn, or which may consist of two or more single yarn strands combined into a ply yarn. Natural fibers or filaments may be used, including naturally-occurring cellulosic fibers such as cotton or flax, naturally-occurring protein-based fibers or filaments such as wool or silk, and naturally-occurring mineral-based materials such as asbestos. Man-made fibers or filaments may be used, including man-made fibers or filaments made from inorganic materials such as glass or metals, as well as fibers or filaments made from regenerated natural polymers, including cellulose-based polymers and protein-based polymers, man-made carbon fibers or filaments, and man-made fibers or filaments made from synthetic polymers. In many cases, the synthetic polymers are thermoplastics, including thermoplastic elastomers, although thermosets such as elastane may also be used. Synthetic polymers commonly used to make fibers or filaments include polyesters (such as polyethylene terephthalate (PET)), polyamides (such as Nylon-6, Nylon 6,6, and Nylon-11), polyolefins (such as propylene homopolymers and copolymers, as well as ethylene homopolymers and copolymers), and polyacetates (such as cellulose acetate fibers). Polyurethanes, such as thermoplastic polyurethanes, may also be used to make fibers or filaments. The strands may comprise or consist of yarn including natural fibers or filaments, man-made fibers or filaments, or a combination of both natural and man-made fibers or filaments, such as a spun yarn comprising a blend of cotton and polyester fibers. The strands may comprise or consist of a multi-filament yarn comprising polyester or polyamide filaments, such as a commercially available embroidery thread.

Generally, industrial knitting machines and other industrial-scale manufacturing processes require the use of yarns having a minimum tenacity of about 1.5 grams per denier. Tenacity refers to the amount of force needed to break a yarn divided by the linear mass density of the yarn and is determined by subjecting a sample of the yarn to a known amount of force until the sample breaks, for example, using a strain gauge load cell. Within the scope of the disclosure, yarns having tenacities greater than about 5 grams per denier are considered to be high tenacity yarns. High-tenacity yarns may include fibers or filaments comprising polymer(s) such as aramids and ultra-high molecular weight polyethelene (UHMWPE). The yarns used in accordance with the present disclosure can be lower tenacity yarns, high tenacity yarns, or any combination thereof. In some examples, the strands may comprise or consist of a spun yarn, a mono-filament yarn, or a multi-filament yarn having a tenacity of at least 1.5 grams per denier, or of at least 2.5 grams per denier. In other examples, the strands may comprise or consist of a multi-filament yarn having a tenacity of at least 11 grams per denier.

Figure 3:
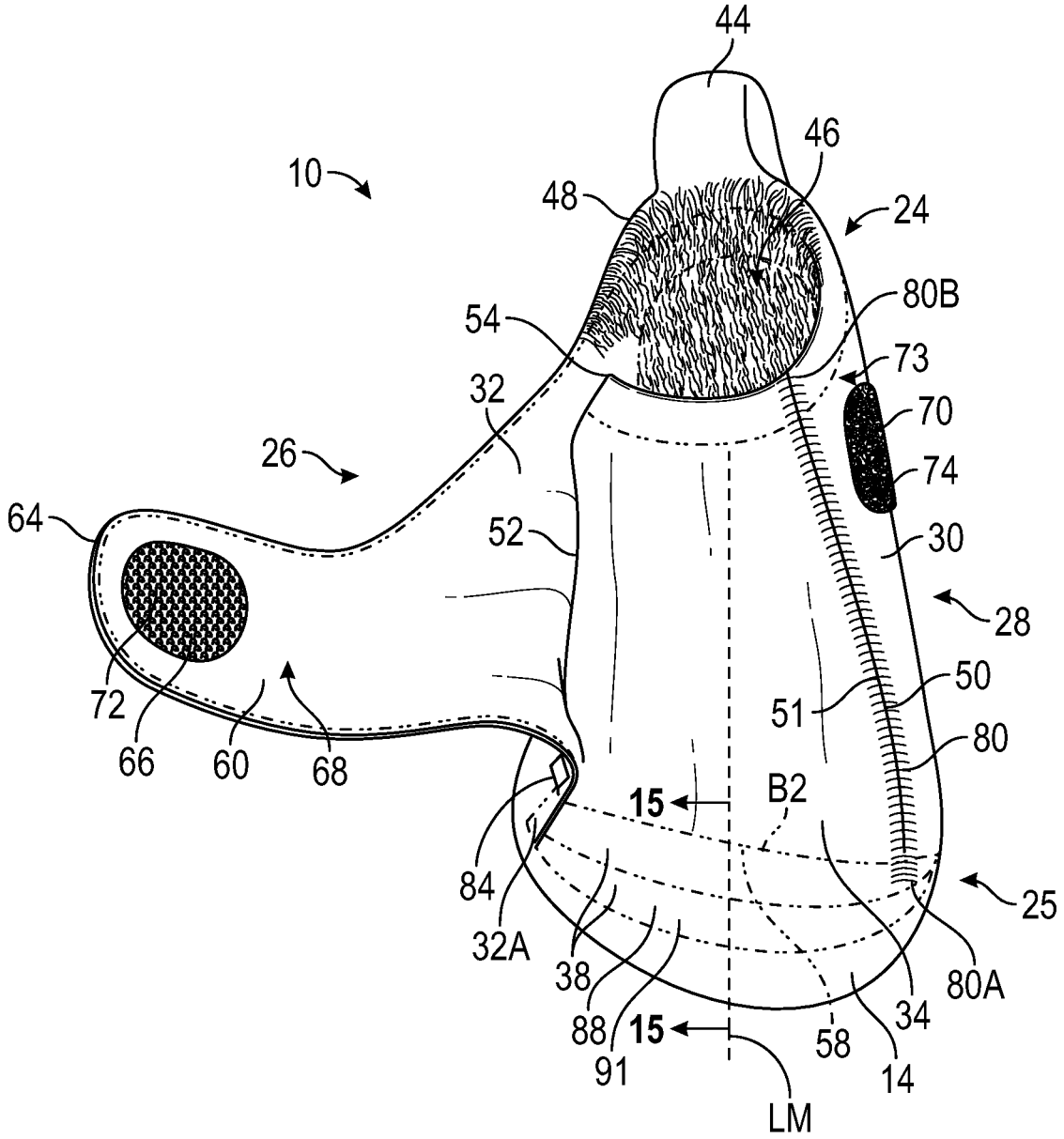
FIG. 3 is a top perspective view of the article of footwear of FIG. 1 with a strap of a knitted lateral quarter shown in an unsecured position.
Figure 4:
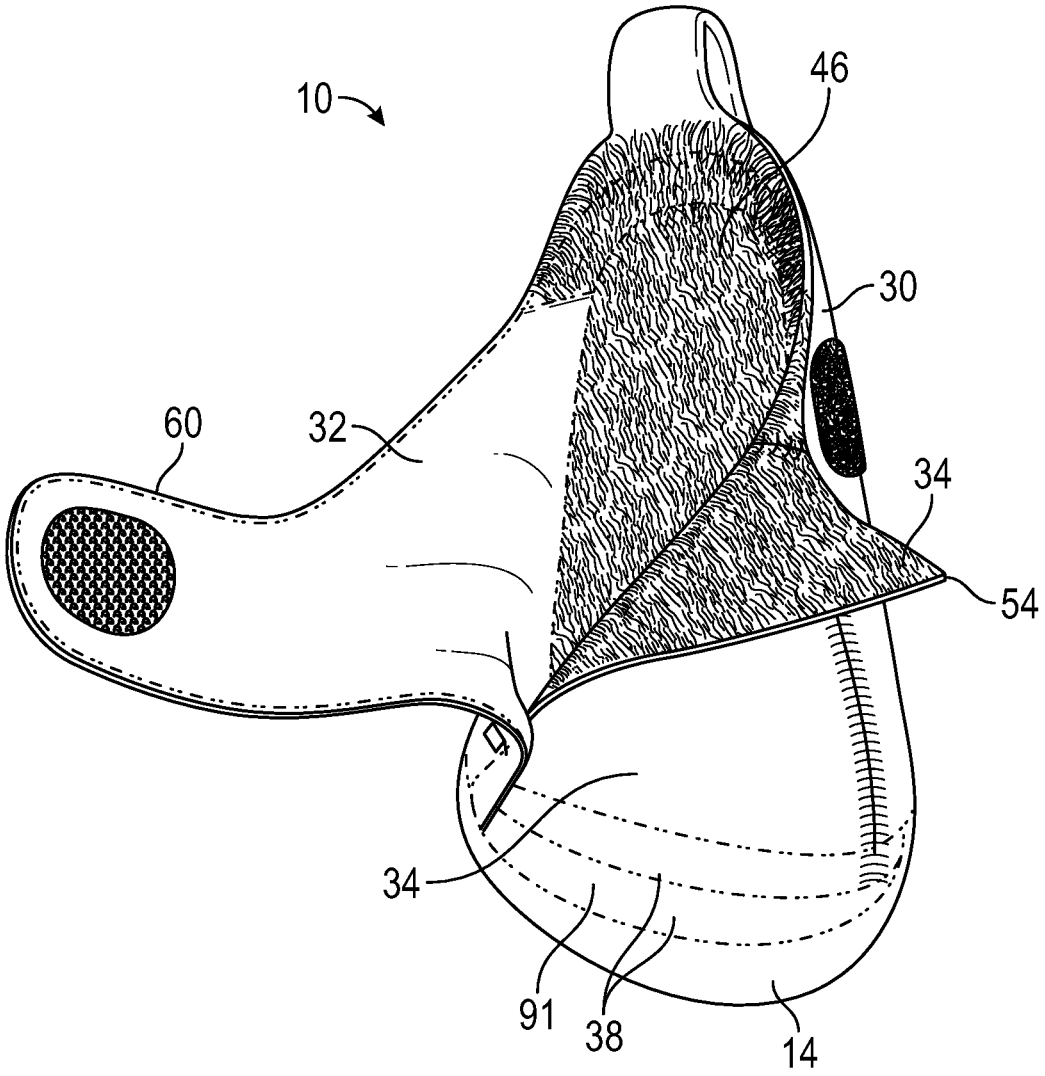
FIG. 4 is a top perspective view of the article of footwear of FIG. 3 with the tongue and medial quarter moved toward the medial side to ease foot entry.

The sole 14 and the footwear upper 12 together define a foot-receiving cavity 46, which is shown partially exposed in FIG. 3 and more exposed in FIG. 4. The knitted medial quarter 30, the knitted lateral quarter 32, the knitted tongue 34, and the knitted heel portion 35 together define an ankle opening 48 at the foot-receiving cavity 46. The knitted collar 42 extends along the knitted medial quarter 30, along the knitted lateral quarter 32, and along the knitted heel portion 35 at the ankle opening 48 and further defines the ankle opening 48.

As best shown in FIG. 3, the knitted tongue 34 has a medial edge 50 extending from the toe region 25 of the article of footwear 10 to the ankle opening 48 at the medial side 28 and stitched to the knitted medial quarter 30 from the toe region 25 to the ankle opening 48. As shown, the medial edge 50 is stitched to an edge 51 of the knitted medial quarter 30. In other embodiments, the medial edge 50 may be stitched to the medial quarter 30 only partway to the ankle opening 48 in order to provide the ability to open the foot-receiving cavity 46 to a greater extent at the medial side 28 when inserting the foot. In still other embodiments, the entire medial edge 50 may be unstitched and unsecured to the medial quarter 30.

The knitted tongue 34 has a lateral edge 52 extending from the toe region 25 to the ankle opening 48 at the lateral side 26. The knitted tongue 34 and the knitted lateral quarter 32 are unstitched and separable from one another at the lateral edge 52 to expand the ankle opening 48 to case entry into the foot-receiving cavity 46. For example, in FIG. 3, the knitted tongue 34 may be gripped at or near a rear lateral corner 54 and lifted forward and to the medial side 28 (e.g., across the longitudinal midline (LM)) to further expose the foot-receiving cavity 46. FIG. 4 shows the knitted tongue 34 moved to this open position, revealing more of the foot-receiving cavity 46.

The footwear upper 12 has a knitted toe box 38 forward of the knitted tongue 34. Specifically, the knitted toe box 38 extends between the knitted tongue 34 and the sole 14 in the toe region 25 and is adjacent to a forward extent 58 of the knitted tongue 34. The forward extent 58 of the knitted tongue 34 is the same as, and is coincident with, the boundary B2.

The knitted lateral quarter 32 extends to form a strap 60. The strap 60 is an integral portion of the knitted lateral quarter 32. As is evident in FIGS. 1 and 3, the knitted lateral quarter 32 extends from the toe region 25 to the heel region 24 of the article of footwear 10 and tapers in width from a proximal end 62 of the knitted lateral quarter 32 at the sole 14 to a distal end 64 of the strap 60. The strap 60 is configured to cross over the knitted tongue 34 and secure at the knitted medial quarter 30 to secure a foot within the foot-receiving cavity 46. More specifically, the tapered shape of the strap 60 along with its length from the proximal end 62 to the distal end 64 enables it to be manipulated once the foot is fully inserted in the foot-receiving cavity 46 by moving the distal end 64 to the medial side 28 so that the strap 60 crosses over the knitted tongue 34 and secures at the knitted medial quarter 30 to secure the foot within the foot-receiving cavity 46.

Referring to FIG. 3, the strap 60 has a first fastener portion 66 secured to an inner side 68 (also referred to as an inner surface) of the strap 60, and the medial quarter 30 has a second fastener portion 70 at an outer side 73 (also referred to as an outer surface) of the medial quarter 30. In the embodiment shown, the first fastener portion 66 and the second fastener portion 70 together comprise a hook-and-loop fastener. One of the first fastener portion 66 and the second fastener portion 70 includes a plurality of loops and the other of the first fastener portion 66 and the second fastener portion 70 includes a plurality of hooks that engage with the loops when the first fastener portion 66 and the second fastener portion 70 are pressed together. In the embodiment shown, the first fastener portion 66 includes hooks 72 and the second fastener portion 70 includes loops 74 with which the hooks 72 engage. Hook-and-loop fastening may be easier for young children and those with limited dexterity to manipulate than other fastener types. Suitable material with hooks and loops is available from 3M Company at 3M Center, St. Paul, Minnesota under the trade name VELCRO™.

The strap 60 is the only strap included in the article of footwear 10 that secures the foot within the foot-receiving cavity 46. Additionally, no zippers, laces, snaps, buttons, or other securement mechanisms are present to secure the upper 12 around the foot. Stated differently, a single strap 60 is used to secure the article of footwear 10 to the foot. Additionally, the strap 60 wraps from the lateral side 26 over the tongue 34 to secure at the medial side 28. Alternatively, in other embodiments, the strap 60 may wrap from the medial side 28 to secure at the lateral side 26. In some embodiments, the footwear may be configured so that it is generally symmetrical about the longitudinal midline LM so that the wearer may choose to don the footwear with the strap 60 wrapping from either the lateral side 26 to secure at the medial side 28, or from the medial side 28 to secure at the lateral side 26.

When donning their footwear, toddlers and young children may sit cross-legged and/or may tend to crouch down and splay their feet outward. Additionally, it may be easier for most toddlers and young children to pull toward the midline of their body (inward) than it is for them to pull away from their body (outward). In light of this, the article of footwear 10 being configured with the strap 60 wrapping from the lateral side 26 over the tongue 34 to secure at the medial side 28 may make it easier for toddlers and young children to secure and release the strap 60 independently than if the strap 60 wrapped from the medial side 28 to the lateral side 26 and secured on the lateral side 26. Additionally, toddlers and young children tend to walk with their feet relatively spread apart so that it is unlikely that the location of the secured first fastener portion 66 and second fastener portion 70 at the medial side 28 would interfere with or be a barrier to their walking mechanics.

Each of the sole 14, the medial quarter 30, the lateral quarter 32 (including the strap 60), the tongue 34, the heel portion 35, the toe box 38, the collar 42, the heel pull 44, and the sole 14 are knitted of a specific yarn or combination of yarns that enable the integrally-knitted, one-piece article of footwear 10 to provide the desired traction, durability, flexibility, and other properties and characteristics with minimal waste and minimal post-processing following knitting of the article of footwear 10.

Figure 5:
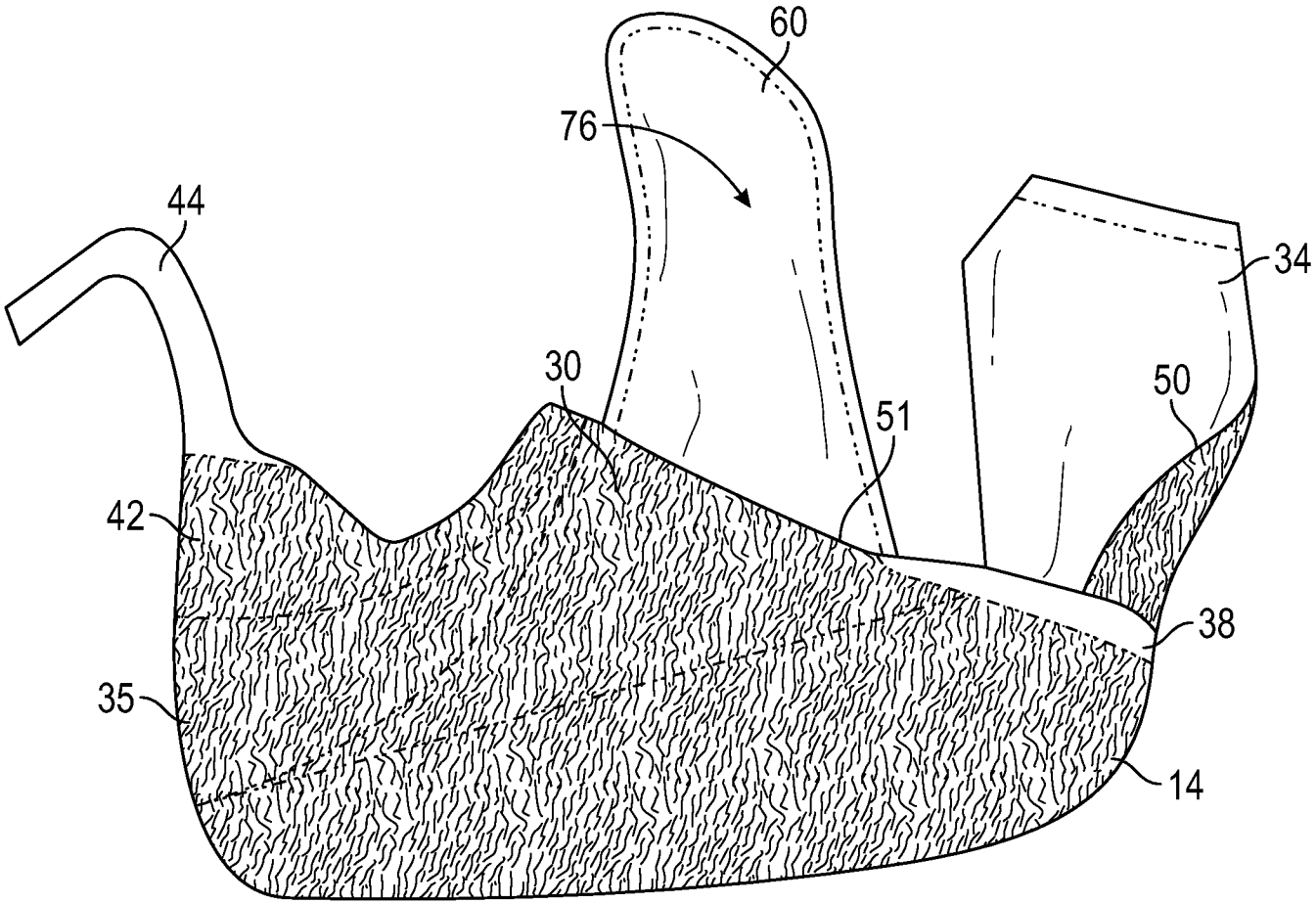
FIG. 5 is a side view of the article of footwear of FIG. 1 turned inside out with an inner side of a knitted medial quarter exposed.

FIG. 5 is a side view of the article of footwear of FIG. 1 turned inside out. An inner side of the knitted medial quarter 30, the sole 14, the heel portion 35, the collar 42, and a portion of the inner side of the tongue 34 are exposed. The article of footwear 10 is shown in FIG. 5 prior to stitching the medial edge 50 of the tongue 34 to the edge 51 of the knitted medial quarter 30. An outer side 76 (also referred to as an outer surface) of the strap 60 is shown in FIG. 5.

Figure 6:
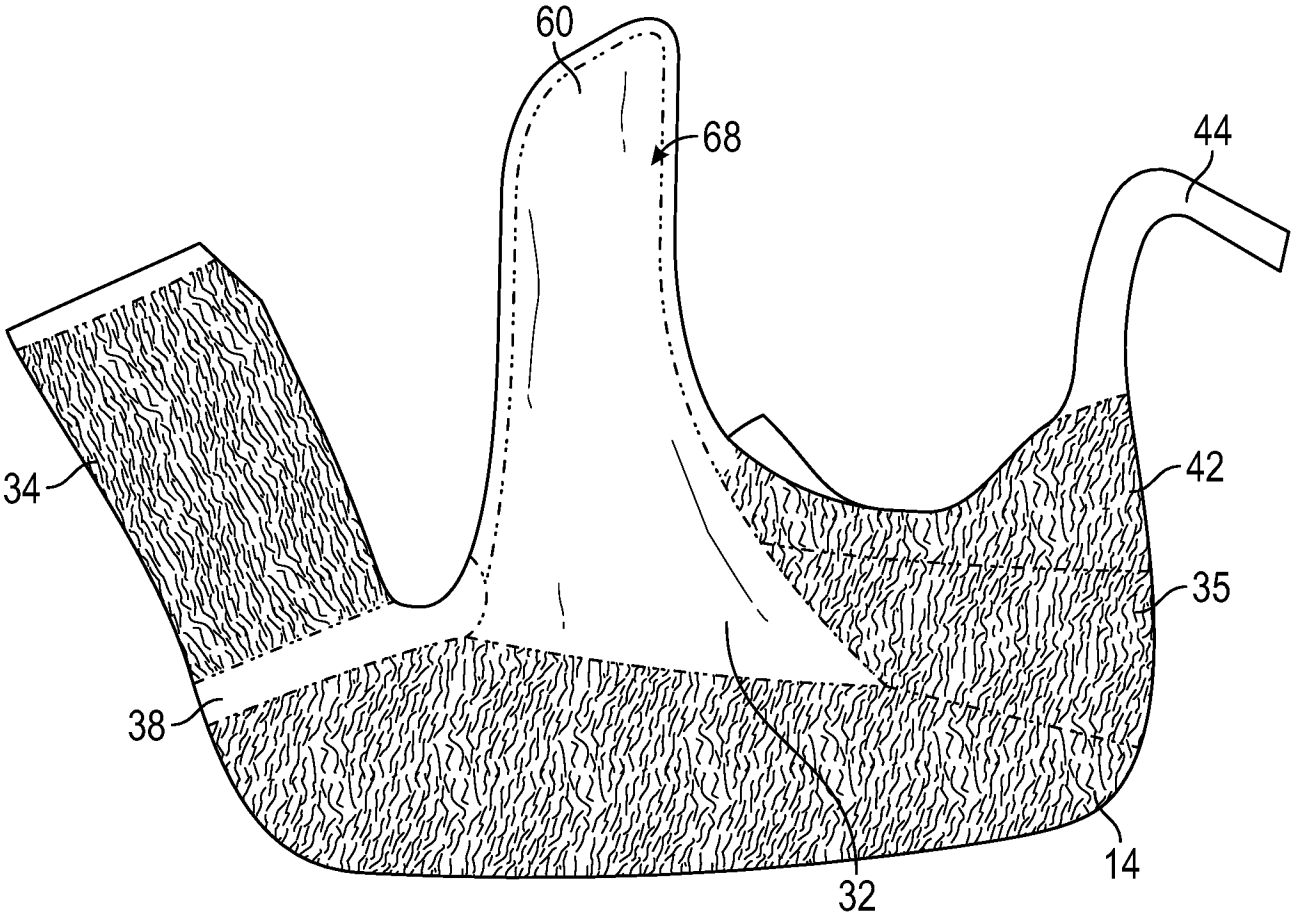
FIG. 6 is a side view of the article of footwear of FIG. 1 turned inside out with an inner side of the knitted lateral quarter and strap exposed.

FIG. 6 is an opposite side view than FIG. 5 with the article of footwear 10 turned inside out. In FIG. 6, an inner side of the knitted lateral quarter 32 and strap 60 are exposed along with the remainder of the inner side of the sole 14, the heel portion 35 and the tongue 34. The inner side 68 of the strap 60 is shown in FIG. 6 prior to securing the fastener portion 70 to the inner side 68. FIGS. 5 and 6 represent that the article of footwear 10 is a unitary one-piece, integrally-knit component following the knitting process and before any post processing such as stitching.

The textured shading in FIGS. 5 and 6 represents a yarn that may be used at the inner side of one or more of the medial quarter 30, the sole 14, the heel portion 35, and the tongue 34 for added comfort against the foot of the wearer. For example, the yarn may be a multi-component yarn, such as a yarn including two or more twisted core yarns with cut pile yarns between the twisted core yarns. For purposes of discussion, such yarn may be referred to herein as chenille yarn, as discussed herein. In some embodiments, the inner side 68 of the lateral quarter 32 including the strap 60 may also have the same yarn.

Referring again to FIG. 3, after the knitting process creates the unitary, one-piece component shown in FIGS. 5 and 6, the medial edge 50 of the tongue 34 is stitched to the edge 51 of the medial quarter 30 using stitching 80. The stitching 80 begins at 80A in the toe box 38 forward of the edges 50, 51 and progresses along the edges 50, 51 to the end 80B of the stitching 80 at the ankle opening 48. By beginning the stitching in the toe box 38, the seam created by the abutting edges 50, 51 is better reinforced.

In order to ensure that the strap 60 overlays the tongue 34 properly without wrinkling or bunching, following stitching of the medial quarter 30 to the tongue 34, the forward edge 82 of the strap 60 may be aligned with markers or other locating features along the outer side of the tongue 34 as it overlays the tongue 34 to the secured position. A reinforcing box stitch 84 may then be applied, extending through the tongue 34 and the lower extent of the strap 60.

The toe region 25 is contoured both from the sole 14 to the tongue 34 and from the medial side 28 to the lateral side 26. The toe region 25 may be the most contoured portion of the article of the article of footwear 10. For example, the toe region 25 is contoured in the vertical direction as it extends from the sole 14 underfoot to the tongue 34 and is contoured in the horizontal direction as it extends from the medial quarter 30 to the lateral quarter 32 and over the toes of the foot. More specifically, the toe region 25 is convex at an exterior and convex at an interior of the toe region 25 in both the vertical direction and the horizontal direction. In order to accommodate this curvature, the knitted toe box 38 may include an elastomeric yarn adjacent to the forward extent 58 of the knitted tongue 34. In one non-limiting example, the elastomeric yarn of the knitted toe box 38 may be an "E04" yarn supplied by Unifi, Inc. of Greensboro, N.C., which preferably has a greater elasticity than other yarns that may be used to form the article of footwear 10. The E04 yarn of the knitted toe box 38, and other yarns referred to herein as E04 yarn, may comprise an elastane core (i.e., LYCRA® available from E.I. duPont de Nemours Company) wrapped with polyester.

Furthermore, in order to reduce the bulk of the article of footwear 10 at the lower forward extent of the lateral quarter 32 and promote case in moving the strap 60 from the open position to the secured position wrinkling, a lower extent 32A of the lateral quarter 32 at the forward edge 82 includes the same elastomeric yarn that forms the knitted toe box 38 and extends contiguously from the knitted toe box 38. The lower extent 32A that includes the same elastomeric yarn is indicated in FIG. 1 and is bounded by the boundary lines B3 and the forward edge 82. The remainder of the lateral quarter 32 may include different types of yarn or yarns that are thicker or less flexible in order to stabilize the foot over the sole 14. By including the lower extent 32A having the same flexible yarn as the toe box 38, the extreme contours of the toe region 25 are accommodated without wrinkling of the upper 12 in the toc region 25.

Other portions of the article of footwear 10 that may benefit from a flexible and thin knitted construction afforded by elastomeric yarn include the knitted collar 42, the knitted heel pull 44, and the outer perimeter 86 of the strap 60 at both the forward edge, the rear edge, and the distal end. Accordingly, in the embodiment shown, each of the knitted collar 42, the knitted heel pull 44, and the outer perimeter 86 of the strap 60 comprise the same or different type of elastomeric yarn as the toe box 38.

Figure 15:
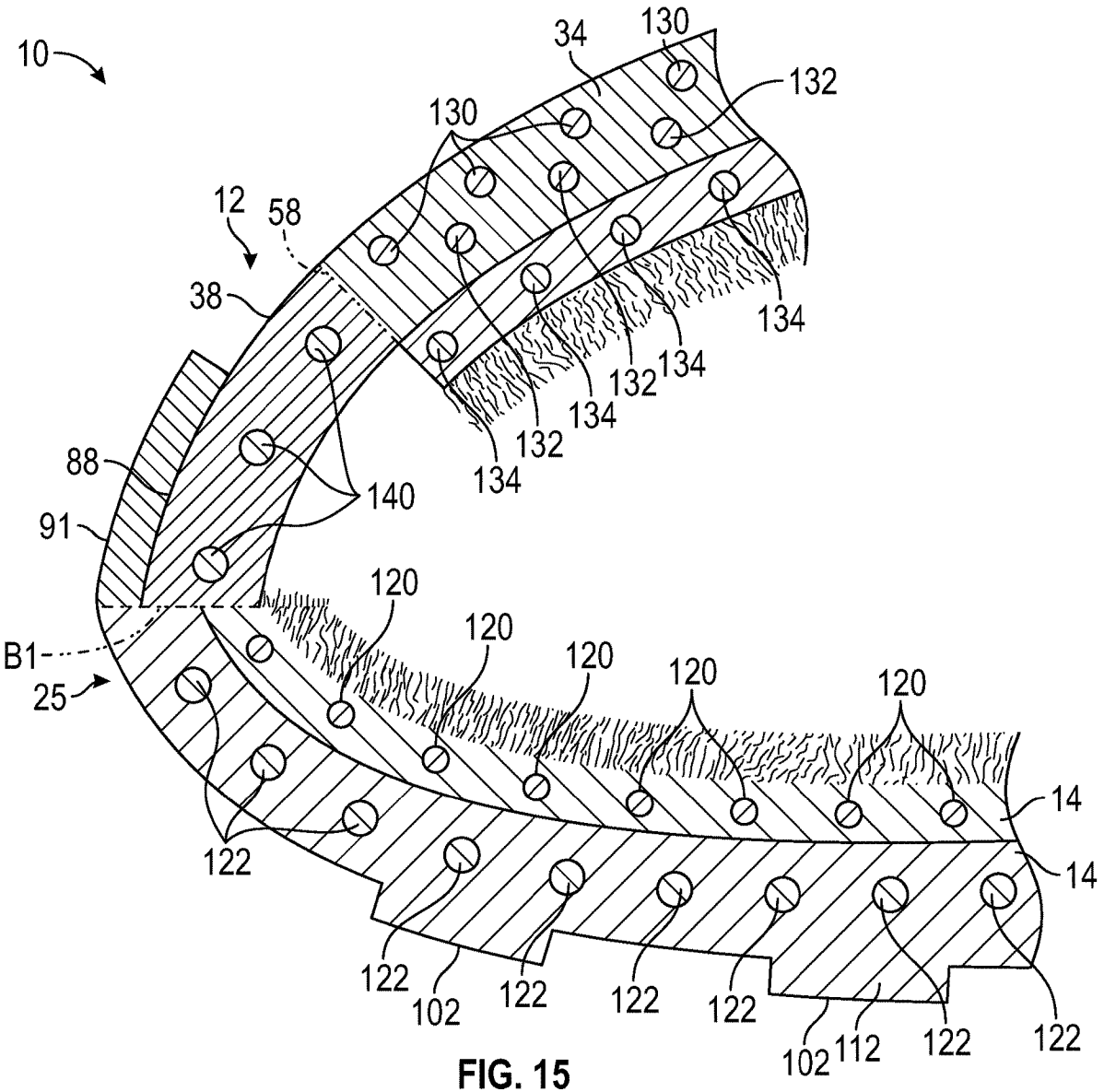
FIG. 15 is a cross-sectional view of the article of footwear taken at lines 15-15 in FIG. 3.

As further discussed with respect to FIG. 15, in order to reinforce at least a lower portion 88 of the toe box 38, also referred to as a forward portion, the knitted toe box 38 may include one or more interlooped yarns comprising a first material, the first material including a thermoplastic material. The interlooped yarns may include yarns comprising a second material having a different melting temperature than the first material. The knitted toe box 38 may include reflowed polymeric material of the thermoplastic material. The second material may have a higher melting temperature than the thermoplastic material. For example, the second material may be elastomeric yarn discussed may be adjacent a forward extent of the knitted tongue and the yarn including the first material may be knitted with the elastomeric yarn of the toe box 38. For example, the yarn comprising the first material may include a core and a sheath, and the sheath may include thermoplastic material that reflows, as described and referred to herein as grip yarn. In some examples, the one or more interlooped yarns in the toe box 38 may at least partially include a thermoplastic polymer material that transitions from a solid state to a softened or liquid state when subjected to a temperature at or above its melting point and then transitions back to the solid state when cooled. Further, in some examples, the thermoplastic polymer material may be melted, reflowed, and solidified. For example, the thermoplastic polymer material may be melted and reflowed over a desired area (e.g., a portion of the toe box 38 such as the lower portion 88) by applying one or more of heat (e.g., temperature at or above the melting temperature of the thermoplastic polymer material) and pressure. After reflowing, the knitted component (e.g., the integrally-knitted footwear upper 12) may be cooled to solidify the reflowed thermoplastic polymer. As a result, the desired area (e.g., the lower portion 88) includes the reflowed and solidified thermoplastic polymer. In one example, the reflowed and solidified material may form a film (also referred to as a skin 91) over the desired area of the knitted component (e.g., the lower portion 88 of the toe box 38 mentioned above). The film may increase durability, abrasion resistance, and weatherization. In another example, the thermoplastic polymer material may be softened and cooled. For example, one or more of a temperature, a pressure, and time of application of heat and/or pressure may be adjusted to soften the thermoplastic material without melting. As a result, the softened thermoplastic polymer may have a higher viscosity compared to the melted thermoplastic material. The softened thermoplastic polymer may spread to adjacent knitted portions (e.g., knitted portions comprising the second material) and join the knitted portions, thereby providing additional strength.

In one example, one or more interlooped yarns may include a core and a sheath, where the sheath includes the thermoplastic polymer material. In some examples, the one or more interlooped yarns comprising the thermoplastic polymer may be a coated yarn (e.g., core coated with sheath, the sheath comprising the thermoplastic polymer material), a monofilament yarn, a bicomponent monofilament yarn (e.g., a thermoplastic polymer co-extruded with another thermoplastic polymer in a core and sheath, or side-by-side configuration), or a multifilament yarn. Examples of thermoplastic polymer materials include but not limited to thermoplastic elastomers, polyamides, polyesters, polyurethane, and polyolefins.

After the article of footwear 10 is knitted and sewn to form the foot-receiving cavity 46, in a post-processing step described herein, the grip yarn at the lower portion 88 of the toe box 38 may be thermoformed to reflow and form a reinforcing skin 91 at the lower portion 88 of the knitted toe box 38 adjacent to the sole 14.

Figure 7:
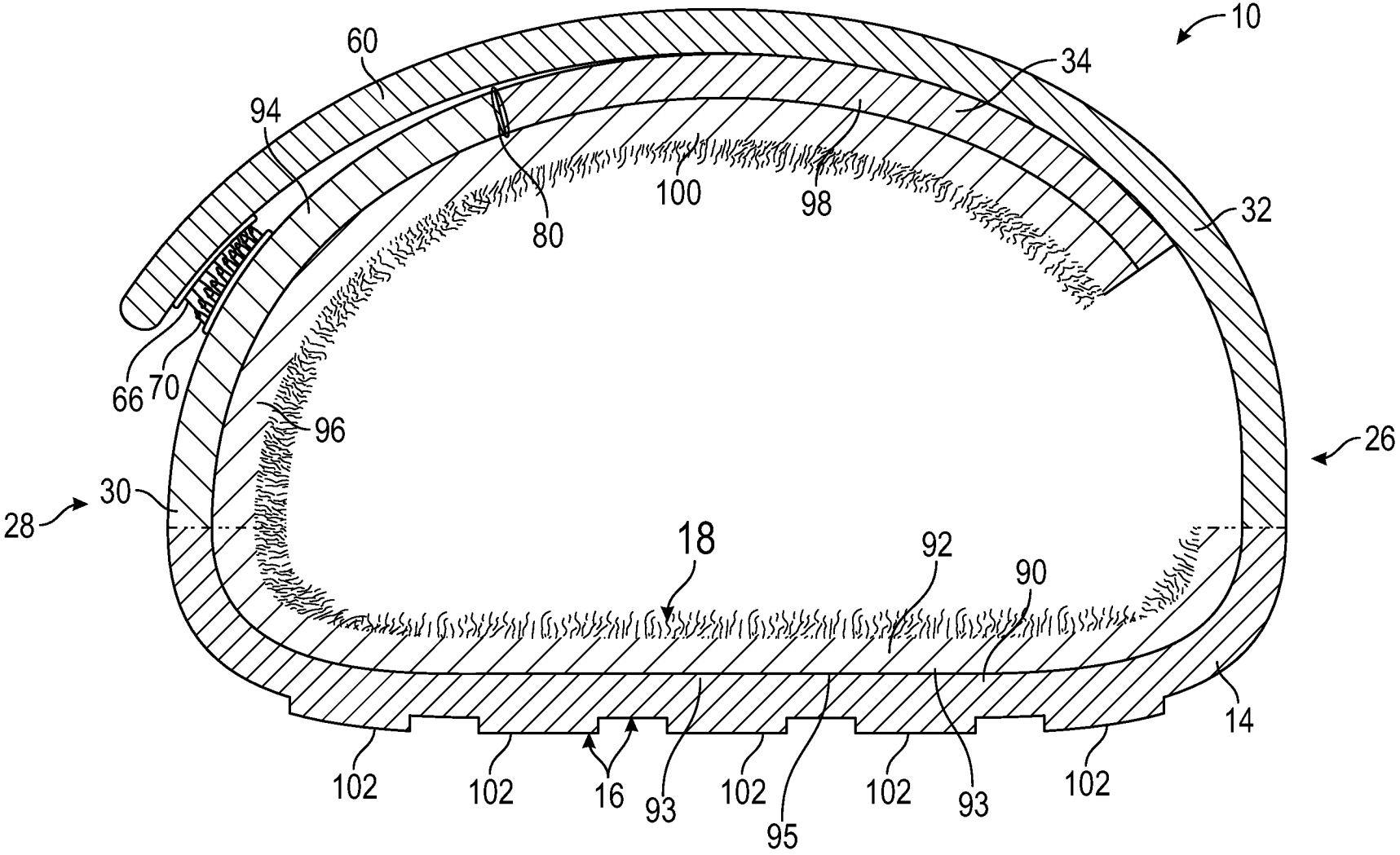
FIG. 7 is a cross-sectional view of the article of footwear of FIG. 1 taken at lines 7-7 in FIG. 1.

FIG. 7 is a cross-sectional view of the article of footwear 10 of FIG. 1 taken at lines 7-7 in FIG. 1. FIG. 7 depicts the sole 14 having an outer layer 90 and an inner layer 92. The outer layer 90 may also be referred to as an external facing layer, and the inner layer 92 may also be referred to as an internal facing layer. It is to be understood that the outer layer 90 and the inner layer 92 are integrally knitted with one another but include at least one different yarn than one another. For example, the outer layer 90 of the sole 14 includes one or more grip yarns.

For example, in certain aspects, a "grip yarn" or grip fiber as described herein is a yarn that may be thermoformed to reflow all or a portion of the yarn to form a surface or at least a reflowed area, such as, for example, a surface or area having particular traction properties, "ball touch" properties, water-proof or water-resistant properties, containment properties, and the like. A grip yarn is also a fusible yarn. However, not all fusible yarns are grip yarns. For example, some fusible yarns may be thermally processed to cause a change in properties of the fusible yarn but without causing the fusible yarn to reflow.

In one aspect, one or more of the grip yarns described herein may have a break strength of from about 0.6 to about 0.9 kilograms of applied force, or of from about 0.7 to about 0.9 kilograms of applied force, or of about 0.8 to about 0.9 kilograms of applied force, or greater than 0.9 kilograms of applied force.

Some grip yarns may comprise or consist essentially of a grip material. The grip material may be a thermoplastic material which is elastomeric, as the grip material may comprise or consists essentially of one or more thermoplastic elastomers.

A grip yarn comprising or consisting essentially of the grip material is understood to include a coating of the grip material, or to include one or more grip fibers where each of the individual grip fibers comprises the grip material, or to include both a grip material coating and grip fibers. The grip fibers of the grip yarn can comprise a plurality of short grip fibers, or can comprise a plurality of long grip filaments, or can comprise a single long grip filament (i.e., a monofilament), or can comprise a combination of short grip fibers and one or more long filaments. Similarly, a grip yarn can comprise a single grip filament, or can comprise a plurality of grip fibers or grip filaments, or can comprise one or more core yarns. When a grip yarn comprises one or more core yarns, each of the one or more core yarns individually may be at least partially coated with the grip material. Alternatively, when a grip yarn comprises one or more core yarns, the one or more core yarns may form a twisted yarn, and the twisted yarn may be at least partially coated with the grip material.

In one aspect, when a grip yarn consists essentially of grip fibers, 95 weight percent or more of the fibers present in the grip yarn are grip fibers. In other aspects, when a grip yarn comprises two or more types of fibers, at least one of the two or more types of fibers are the grip fibers. When a grip yarn comprises two or more types of fibers, the grip fibers may make up at least 10 weight percent, or at least 25 weight percent, or at least 50 weight percent, or at least 75 weight percent of the fibers present in the grip yarn.

In one aspect, a grip yarn may include a core coated by the grip material. The grip yarn core comprises a core material, where the core material comprises a different type of polymer and/or has different properties than the grip material. The core material can be a polymeric material comprising one or more polymers, or can comprise a non-polymeric material. When the core material is polymeric, the polymers present in the core material may be different types of polymers than those present in the grip material. For example, the core material may comprise one or more polyester homopolymers or polyamide homopolymers, while the grip material may be essentially free of polyester homopolymers or polyamide homopolymers. When the core material is a thermoplastic material, the core material may have a higher deflection or melting temperature than the grip material, where deflection temperature is the temperature at which the core material temporarily changes shape. When the core material is a non-polymeric or a thermoset material, the core material may have a degradation temperature which is higher than the melting temperature of the grip material, where degradation temperature is the temperature at which physical or mechanical properties of the core material change, for example. The core material may be inelastic or less elastic (e.g., have a lower percent elongation) than the grip material.

In one aspect, the core of the grip yarn may comprise one or more fibers. In this aspect, the grip material may fully or partially coat the core. The one or more core fibers can be a plurality of short fibers, such as a plurality of staple-length fibers spun into a single yarn, or a plurality of staple-length fibers spun into two or more yarns, where the two or more yarns are twisted together. The one or more core fibers can be a plurality of long filaments. The plurality of long filaments can be aligned, or can be aligned and entangled. The one or more core fibers can be a single long monofilament.

In one aspect, the grip yarn may be a coated yarn, wherein a core yarn comprises a core material and a coating layer disposed on the core yarn, the coating layer comprising the grip material, wherein the grip material has a grip material melting temperature. In one aspect, the core material is thermoplastic and has a deformation temperature, i.e., the temperature at which the core material permanently changes shape, and the deformation temperature is at least 20 degrees Celsius greater, at least 50 degrees Celsius greater, at least 75 degrees Celsius greater, or at least 100 degrees Celsius greater than the melting temperature of the grip material.

The grip material may comprise or consist essentially of one or more thermoplastic elastomers. Optionally, in addition to comprising the one or more thermoplastic elastomers, the grip material can further comprise one or more additional polymers, or one or more additional non-polymeric additives, or can comprise both. The one or more thermoplastic elastomers of the grip material may include one or more thermoplastic polyurethane (TPU) elastomers, or one or more thermoplastic styrene elastomers, or a combination of both. In some aspects, the one or more thermoplastic elastomers is two or more thermoplastic elastomers, such as, for example, two or more TPU elastomers, or two or more styrene elastomers, or a combination of two TPU elastomers and a styrene elastomer, or a combination of two styrene elastomers and a TPU elastomer.

As used herein, a polymeric composition (such as the grip composition or a core composition) is understood to include a polymeric component consisting of all the polymers present in the polymeric composition. The polymeric component can consist of a single polymer, or can consist of two or more polymers. In one aspect, the polymeric component consists of one or more polymers of a single type. For example, the polymeric component of the core material can consist of one or more polyesters, or one or more polyethers, or one or more polyamides, or one or more polyurethanes, or one or more polyolefins. The polymeric component of the core material can consist of one or more polyesters. The polymeric component of the core material can consist essentially of polyethylene terephthalate (PET). The polymeric component of the grip material can consist of one or more one or more TPU elastomers, or one or more styrene elastomers. The polymeric component of the grip material can consist of one or more polyester-polyurethane elastomers. The polymeric component of the grip material can consist of one or more styrene-butadiene-styrene (SBS) elastomers. The core material of the core fibers or core yarn may be any material which retains its strength at the temperature at which the grip material is applied to the core fibers or core yarn. The core fibers which are coated with the grip material, and/or the fibers used to form the core yarn, may be natural fibers or regenerated fibers or filaments, or synthetic fibers or filaments. In one aspect, the core fibers or core yarn comprises or consists essentially of natural or regenerated materials such as cotton, silk, wool, or rayon, which are not thermoplastic, and so which have degradation temperatures but not melting or deformation temperatures. In another aspect, the core material of the core fibers or core yarn comprises or consists essentially of one or more synthetic thermosets, such as thermoset polyurethanes or thermoset polyureas, which also have degradation temperatures but not melting or deformation temperatures. In yet another aspect, the core material of the core fibers or core yarn comprises or consists essentially of one or more synthetic thermoplastics such as polyesters, polyamides, polyurethanes, polyolefin, copolymers thereof, and mixtures thereof. In one aspect, the core material comprises or consists essentially of one or more polyesters, or one or more polyamides. In one example, the one or more polyesters comprises or consists essentially of polyethylene terephthalate (PET). In one aspect, the core material is a thermoplastic material, and has a deformation temperature greater than 200 degrees Celsius, or greater than 220 degrees Celsius, or greater than 240 degrees Celsius, or from about 200 degrees Celsius to about 300 degrees Celsius.

Figure 10:
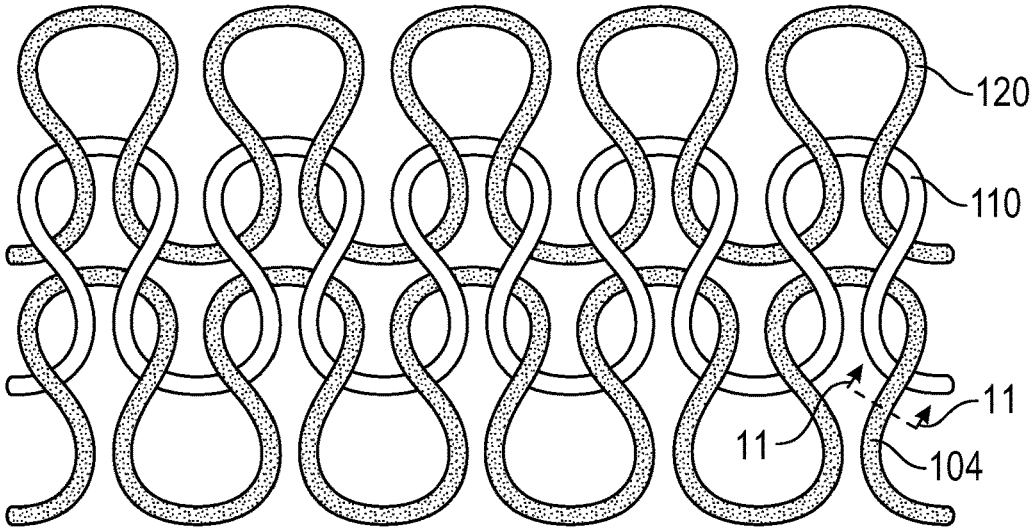
FIG. 10 is a schematic illustration of yarns of the knitted sole, including grip yarns prior to thermal processing.
Figure 11:
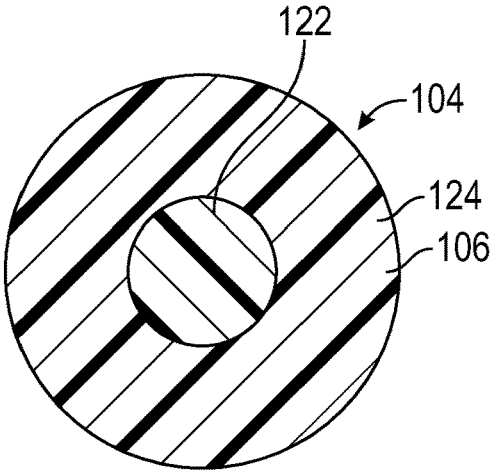
FIG. 11 is a schematic cross-sectional view of one of the grip yarns of FIG. 10 prior to thermal processing.
Figure 12:
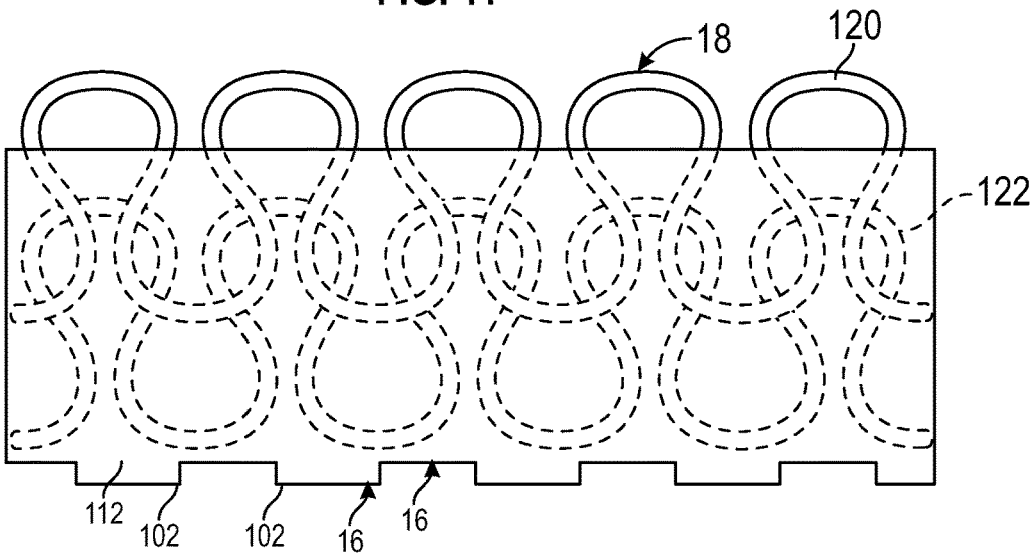
FIG. 12 is a schematic illustration of yarns of the knitted sole after thermally processing the grip yarns.

FIGS. 10-12 describe in greater detail the two types of grip yarn utilized in the outer layer 90 of the sole 14 as well as the yarn of the inner layer 92 of the sole 14 of the article of footwear 10. The inner layer 92 includes a yarn different than the grip yarn or yarns of the outer layer 90. The inner layer 92 establishes the footbed and includes a foot-contact surface 18. To promote comfort, the yarn of the inner layer 92 may comprise chenille yarn.

FIG. 7 also illustrates that the medial quarter 30 and the tongue 34 also each have an outer layer and an inner layer. The medial quarter 30 has an outer layer 94 and an inner layer 96 integrally knit with the outer layer 94. The inner layer 96 comprises at least one yarn that is different than the yarn or yarns of the outer layer 94. Similarly, the tongue 34 has an outer layer 98 and an inner layer 100 integrally knit with the outer layer 98. The inner layer 100 comprises at least one yarn that is different than the yarn or yarns of the outer layer 98. The yarns of the inner layer 96 and outer layer 94, and the yarns of the inner layer 100 and outer layer 98 are discussed in more detail with respect to FIG. 14. It is noted that the inner layer 96 of the medial quarter 30 and the inner layer 100 of the tongue 34 are at the foot-receiving cavity 46, like the inner layer 92 of the sole 14. To further enhance comfort, the yarn or yarns of the inner layer 96 and the inner layer 100 may also comprise chenille yarn, for example.

FIG. 7 shows that the outer layer 90 of the sole 14 may include integral traction features 102 such as lugs at the ground contact surface 16. The integral traction features 102 may also be referred to as raised traction elements. For example, reflowed polymeric material of the one or more yarns used in the outer layer 90 of the sole 14 may be molded during the thermoforming of the sole 14 to define the traction features 102. The sole 14 may include one or more interlooped yarns comprising a first material, the first material including a thermoplastic material. The interlooped yarns may include yarns comprising a second material having a different melting temperature than the first material. The sole 14 may include reflowed polymeric material of the thermoplastic material. The second material may have a higher melting temperature than the thermoplastic material. For example, the yarn comprising the first material may include a core and a sheath, and the sheath may include thermoplastic material that reflows, as described and referred to herein as grip yarn. As discussed with respect to FIGS. 10-12, the ground contact surface 16 may include a reflowed polymeric material of a yarn 104, which may be referred to herein as a grip yarn, and specifically reflowed thermoplastic material 106 of the sheath 124 of the grip yarn 104. Furthermore, a second grip yarn 110 may also be integrally knit with the grip yarn 104 in the outer layer 90 of the sole 14. The ground contact surface 16 may further include reflowed polymeric material of the second grip yarn 110, such that the outer layer 90 and the ground contact surface includes a reflowed and resolidified polymeric composition 112 that includes both the reflowed thermoplastic material 106 and the reflowed polymeric material of the second grip yarn 110. The sole 14 includes one or more intersection portions 93 at or near a junction 95 of the external facing layer (outer layer 90) and the internal facing layer (inner layer 92) that include the first material.

Figure 9:
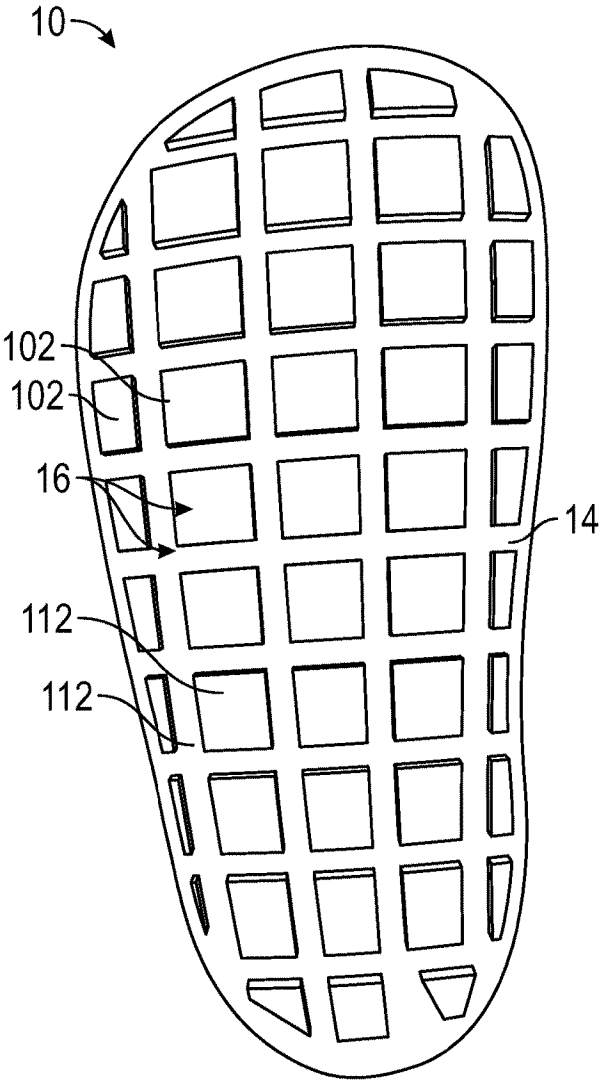
FIG. 9 is a bottom view of the article of footwear of FIG. 1 showing the sole with the grip yarn thermally processed.
Figure 8:
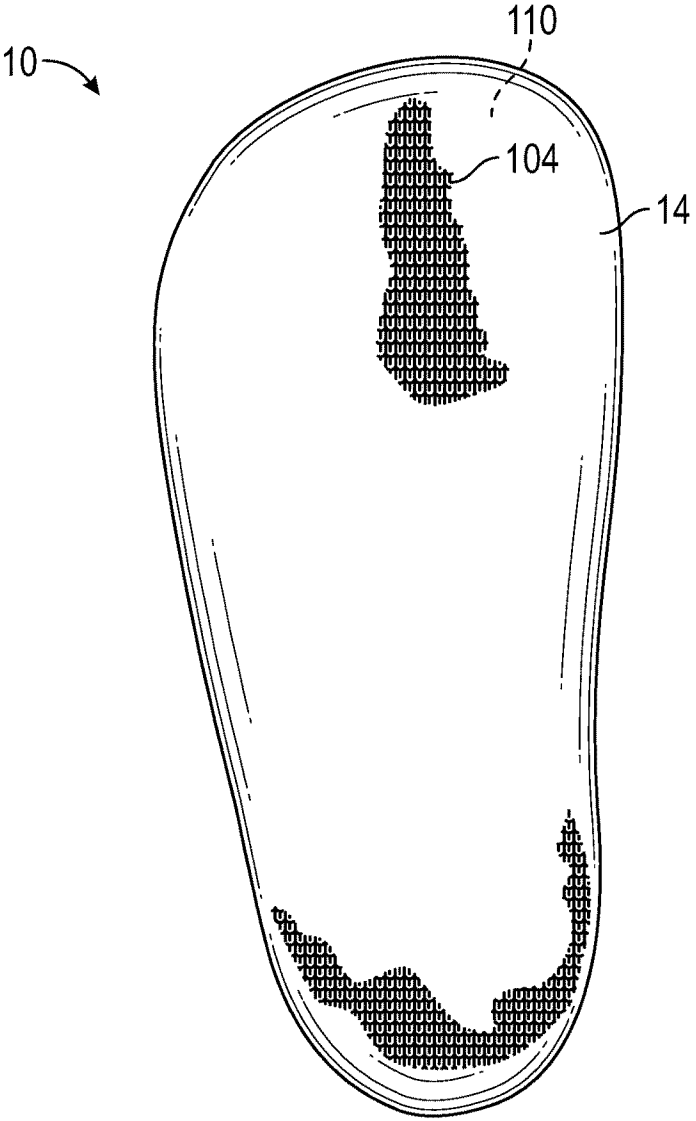
FIG. 8 is a bottom view of the article of footwear of FIG. 1 showing the sole prior to thermally processing the grip yarn.

FIG. 8 is a bottom view of the article of footwear 10 of FIG. 1 showing the bottom of the sole 14 prior to thermally processing the grip yarns 104, 110. The knit texture of the sole 14 may be more readily apparent prior to the thermal processing (e.g., the thermoforming). The grip yarn 104 may be knit at the outermost side of the sole 14. FIG. 9 is a bottom view of the article of footwear 10 of FIG. 1 showing the sole 14 after thermal processing of the sole 14 so that the polymeric composition 112 defines at least a part of the ground contact surface 16, including the traction features 102.

FIG. 10 is a schematic illustration of one example combination of knitted yarns of the knitted sole 14 shown prior to a post-knitting thermal process. The sole 14 may comprise a first grip yarn 104 knit at one side that will be the outer layer and become the ground contact surface 16, a second grip yarn 110 of a different type than the first grip yarn 104 interlooped with the first grip yarn 104, and a third yarn 120 of a different type than both the first and second grip yarns 104, 110. The third yarn 120 is interlooped with at least the second grip yarn 110 and disposed at an opposite side that will be the inner layer and become the foot-contact surface 18.

FIG. 11 is a schematic cross-sectional view of the first grip yarn 104 taken at lines 11-11 in FIG. 10. The grip yarn 104 includes a core 122 and a sheath 124 surrounding and coating the core 122. The sheath 124 may also be referred to as a coating and includes the thermoplastic material 106. The core 122 excludes the thermoplastic material 106. As previously discussed herein with respect to grip yarns, the core 122 may be a polymeric material comprising one or more polymers, or can comprise a non-polymeric material. When the material of the core 122 is a thermoplastic material, it may have a higher deflection or melting temperature than the material of the sheath 124. When the material of the core 122 is a non-polymeric or a thermoset material, it may have a degradation temperature which is higher than the melting temperature of the material of the sheath 124. The material of the core 122 may be inelastic or less elastic (e.g., have a lower percent elongation) than the material of the sheath 124. In one nonlimiting example, the melting temperature of the sheath 124 may range from about 155 degrees Celsius to about 160 degrees Celsius.

Unlike the first grip yarn 104, the second grip yarn 110 may include a uniform polymeric material rather than a core and a sheath and may entirely reflow during thermal processing. Both the thermoplastic material 106 of the sheath 124 and the polymeric material of the second grip yarn 110 may have melting temperatures within a given range of temperatures that is lower than a deformation temperature of the core 122 and lower than a deformation temperature of the third yarn 120. Stated differently, the second material of the core 122 has a greater melting temperature than a first material of the sheath 124, where the first material of the sheath 124 is the thermoplastic material 106. This enables the thermoplastic material 106 of the sheath 124 and the polymeric material of the second grip yarn 110 to reflow and together form a reflowed polymeric composition 112 at the ground contact surface 16 during a heat pressing process described herein that also molds the traction features 102.

FIG. 12 is a schematic illustration of the knitted sole after the heat pressing process. The core 122 of the first grip yarn 104 remains intact and is now encased in the reflowed polymeric composition 112. The third yarn 120 remains extending at the foot-contact surface 18. The third yarn 120 may be the same or may be different than the material(s) at the portions of the foot-contact surface 18 in the foot-receiving cavity 46 formed by the portions of the upper 12 and may be chenille yarn. As shown in FIG. 12, the first material 106 now included in the reflowed polymeric composition 112 is at least partially fused with the one or more core yarns 122 and is at least partially fused to a portion of the one or more interlooped third yarns 120.

Accordingly, the external facing layer (outer layer 90) includes a first material comprising a thermoplastic material (e.g., the reflowed polymeric composition 112) and the internal facing layer (inner layer 92) includes a second material (e.g., the one or more twisted core yarns with cut piles yarns between the core yarns, such as chenille) different from the first material. One or more portions of the external facing layer including the first material thus have a different coefficient of friction relative to the internal facing layer including the second material. The one or more portions may include the integral traction features 102, for example, which may have a greater coefficient of friction relative to the internal facing layer including the second material.

Figure 13:
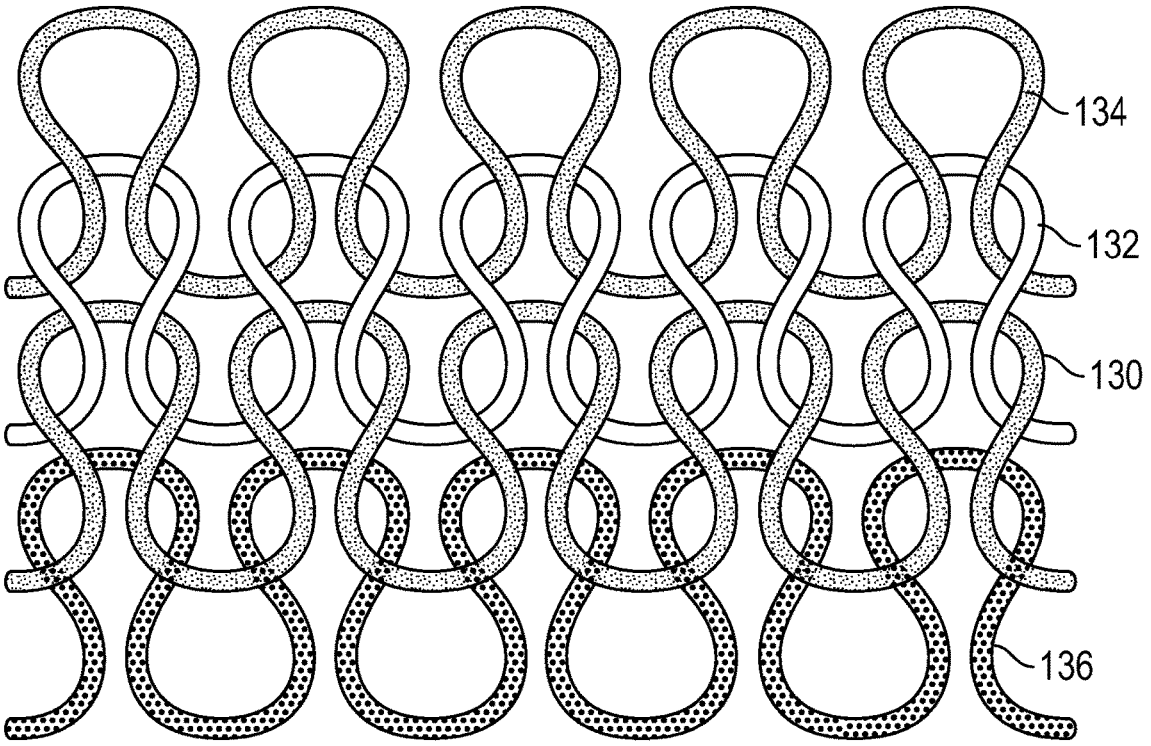
FIG. 13 is a schematic illustration of yarns of the knitted medial quarter, the knitted tongue, and the knitted heel portion.

FIG. 13 shows an exemplary combination of knitted yarns that may be representative of the yarns of the medial quarter 30, the tongue 34, and the heel portion 35, for example. A first yarn 130 and a second yarn 132 may be interlooped and may together at least partially define a respective outer layer of the medial quarter 30, the tongue 34, and the heel portion 35. A third yarn 134 may be integrally knit with at least one of the first and second yarns 130, 132, and is shown in FIG. 13 interlooped with the second yarn 132. The first yarn 130 may comprise a first material, the second yarn 132 may comprise a second material different than the first material, and the third yarn 134 may comprise a third material different than both the first material and the second material.

In an example, the first yarn 130 may comprise a polyester yarn with an elastic core, such as a strand of polyester yarn air tacked to a strand of spandex. The first yarn 130 may be made from one or more organic, natural materials, and/or may be renewable, and/or may be biodegradable. The second yarn 132 may comprise a high tenacity yarn, for example.

The first yarn 130 and the second yarn 132 may each have a lower melting temperature or deformation temperature than a melting temperature of the grip yarns 104, 110 of the sole 14.

The third yarn 134 may comprise chenille yarn such that the inner layer of each of the medial quarter 30, the tongue 34, and the heel portion 35 at the foot-contact surface 18 comprises chenille yarn as indicated in FIGS. 5-7. The third yarn 134 may be the same type of chenille as the yarn 120 of the sole 14. In some embodiments, the yarns at the outer side of the upper 12 along the perimeter of the strap 60, the top edge of the tongue 34, and the upper edge of the ankle opening 48 may also include a chenille yarn.

A fourth yarn 136 may be included in the combination of knitted yarns medial quarter 30, the tongue 34, and the heel portion 35 and is shown interlooped with the first yarn 130 in FIG. 13. The fourth yarn 136 may be referred to herein as a fusible yarn that is not a grip yarn. The fourth yarn 136 may be configured to melt or deform during a steaming process (e.g., the melting temperature or the deformation temperature of the fourth yarn 136 is lower than the melting temperature of the grip yarns 104, 110 of the sole 14), and the steaming process applied to the fourth yarn 136 of the upper 12 is at a lower temperature or temperature range than the temperature or temperature range of the heat pressing process described herein (e.g., a thermoforming process) at which the grip yarns of the sole 14 reflow. Thermally processing the fourth yarn 136 during a steaming process described herein is thus at a sufficiently low temperature that it will not melt the grip yarns 104, 110 and will not cause them to reflow. For example, the melting temperature and/or the deformation temperature of the fourth yarn 136 is less than the melting temperature(s) of the grip yarns 104, 110.

Figure 14:
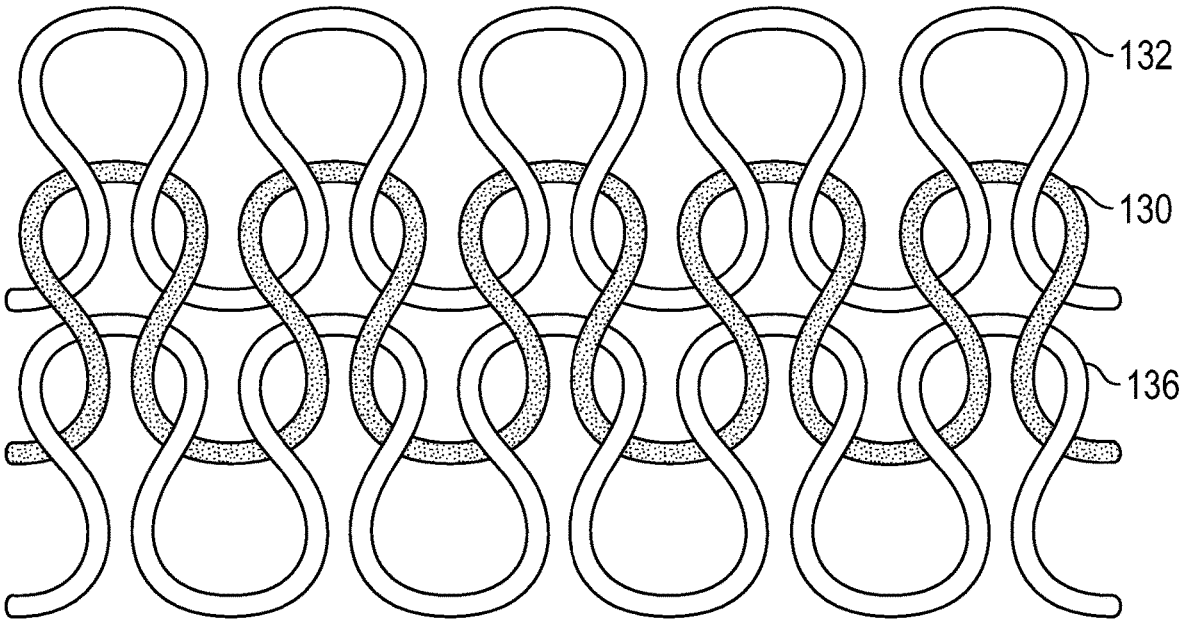
FIG. 14 is a schematic illustration of the yarns of the knitted lateral quarter.

FIG. 14 shows an exemplary combination of knitted yarns that may be representative of the yarns of the knitted lateral quarter 32 and the strap 60 that is a portion of the knitted lateral quarter 32, for example. The first yarn 130 and the second yarn 132 may be the same as described with respect to FIG. 13. The yarn 136 (referred to as the fourth yarn with respect to FIG. 13) may also be used. Notably absent from the combination of yarns in FIG. 14 used for the knitted lateral quarter 32 and the strap 60 is yarn 120, referred to as the third yarn of FIG. 13, and which may be chenille yarn. In other embodiments, such as discussed with respect to FIG. 16, the knitted lateral quarter 32 and the strap 60 that it defines may also include the yarn 120.

FIG. 15 shows the toe region 25 of the article of footwear 10 in cross sectional view, including the yarns described with respect to FIGS. 10-13 depicted schematically. The knitted toe box 38 may comprise an elastomeric yarn 140 in order to provide the flexibility for the contoured shape of the toe box 38, as discussed herein. To strengthen the toe box 38, the lower portion 88 of the toe box 38 may be melted/reflowed to form the reinforcing skin 91 adjacent to the sole 14, as previously discussed. Thus, a first portion of the toe box 38 (e.g., an upper portion) may have greater elasticity than a second portion of the toe box 38 (e.g., the lower portion 88 towards the biteline). Thus, the reinforcing skin 91 improves abrasion resistance and weatherization while the more elastic portion improves flexibility during movement. In some examples, the entire toe box 38 may be melted and reflowed to form the reinforcing skin 91.

The knitted collar 42 and the knitted heel pull 44 may also comprise one or more elastomeric yarns. In an example, the knitted collar 42 and the knitted heel pull 44 both comprise the same elastomeric yarn as the toe box 38.

In one nonlimiting example embodiment, the chenille yarn discussed herein, such as the yarn 120 may be 200TM (twist multiple chenille yarn); and/or the elastomeric yarn of the knitted toe box 38 may be an "E04" yarn supplied by Unifi, Inc. of Greensboro, N.C., which preferably has a greater elasticity than other yarns that may be used to form the article of footwear 10, and/or the E04 yarn of the knitted toe box 38, and other yarns referred to herein as E04 yarn, may comprise an elastane core (i.e., LYCRA® available from E.I. duPont de Nemours Company) wrapped with polyester; and/or the second grip yarn 110 may be K140 500 D grip yarn, as used herein, "K140" grip yarn comprises a fusible bonding yarn with a melting temperature of about 140 degrees Celsius, and K140 500D grip yarn has a linear mass density of about 500 denier, and one example suitable K140 yarn is "Grilon® K140," available commercially from EMS-Chemie AG of Switzerland; and/or the first yarn 130 may comprise a "P15" yarn, which, as used herein, is a polyester yarn with an elastic core, such as a strand of polyester yarn air tacked to a strand of spandex and/or may be made from one or more organic, natural materials, and/or may be renewable, and/or may be biodegradable; and/or the second yarn 132 may comprise a high tenacity yarn including polyester and other compositions formed into yarns having a tenacity in the range of at least approximately six grams-force per denier, e.g., approximately 6-10 grams-force per denier, such as polyester yarns having linear densities ranging from approximately 275-325 denier and a maximum tensile strength of at least 1,650 grams-force; and/or the fourth yarn 136 may be referred to as "KE60", such as KE60 167 dtex Fusible Yarn obtained from EMS (Domat/Ems, Switzerland), having a melting temperature of about 60 degrees Celsius.

Figure 16:
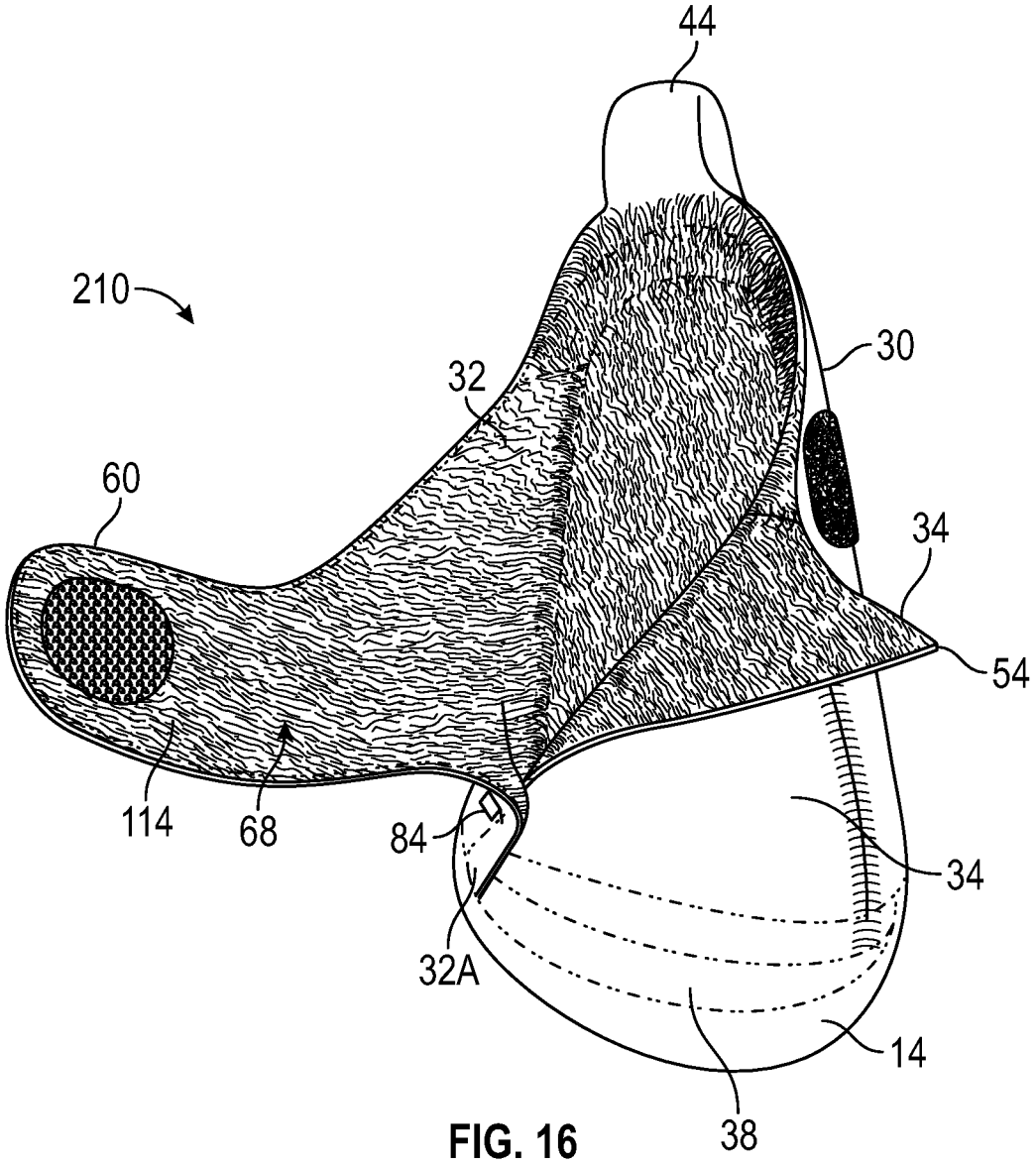
FIG. 16 is a front perspective view of an alternative embodiment of an article of footwear within the scope of the present disclosure showing the strap of the knitted lateral quarter in an unsecured position and with the tongue and medial quarter moved toward the medial side to ease foot entry.

FIG. 16 is a front perspective view of an alternative embodiment of an article of footwear 210 within the scope of the present disclosure. The article of footwear 210 is identical to the article of footwear 10 except that an inner layer 114 at the inner side 68 of the strap 60 and knitted lateral quarter 32 also includes a yarn such as the yarn 120 described herein, which may be a chenille yarn, so that chenille yarn fully surrounds the foot in the foot-receiving cavity 46.

Figure 17:
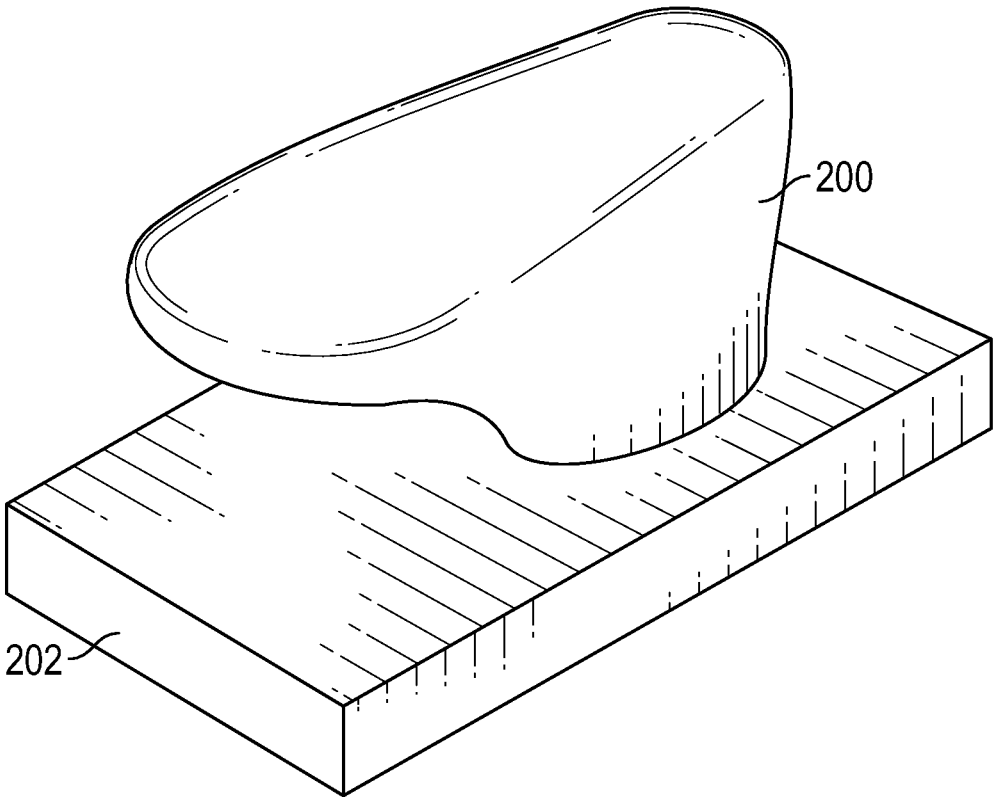
FIG. 17 is a perspective illustration of a last for the article of footwear.
Figure 18:
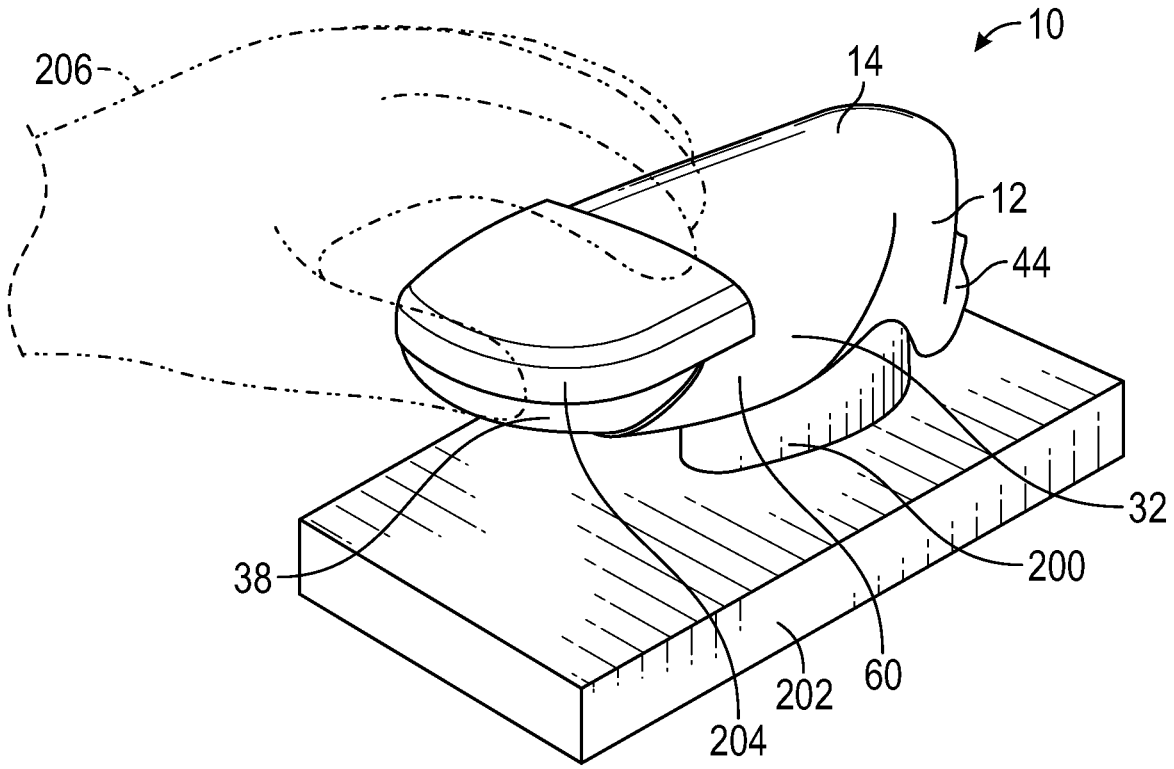
FIG. 18 is a perspective illustration of the article of footwear on the last of FIG. 17 with a hand shown in phantom adjusting the position of the article of footwear on the last using a toe adjustment block.

Once the upper 12 and sole 14 are integrally knit and the edge 50 of the tongue 34 is stitched to the edge 51 of the medial quarter 30 to form the foot-receiving cavity 46, the integrally-knitted footwear upper 12 and sole 14 are placed on a foot-shaped last 200 shown in FIG. 17. The last 200 extends from a base 202. In FIG. 18, the integrally-knit article of footwear 10 is shown placed on the last 200. With the article of footwear 10 on the last 200, the strap 60 formed by the lateral quarter 32 is secured to the medial quarter 30 using the fastener portions 66, 70 or otherwise so that it does not contact any portion of the heat press during processing.

Both the sole 14 and the lower portion 88 of the toe box 38 are thermally processed by thermoforming in separate heat-treating steps. In order to thermally process only the intended portions of the sole 14 and toe box 38 during these steps, the article of footwear 10 is precisely positioned on the last 200 by registering the knitted footwear upper 12 and sole 14 to the last 200. This helps to minimize heat transfer to other areas of the upper 12 that were previously steamed prior to stitching of the edge 50, 51, in order to not cause any other portions of the upper 12, including the fourth yarn 136 that may be therein, to heat and cool into the wrong shape.

Figure 19:
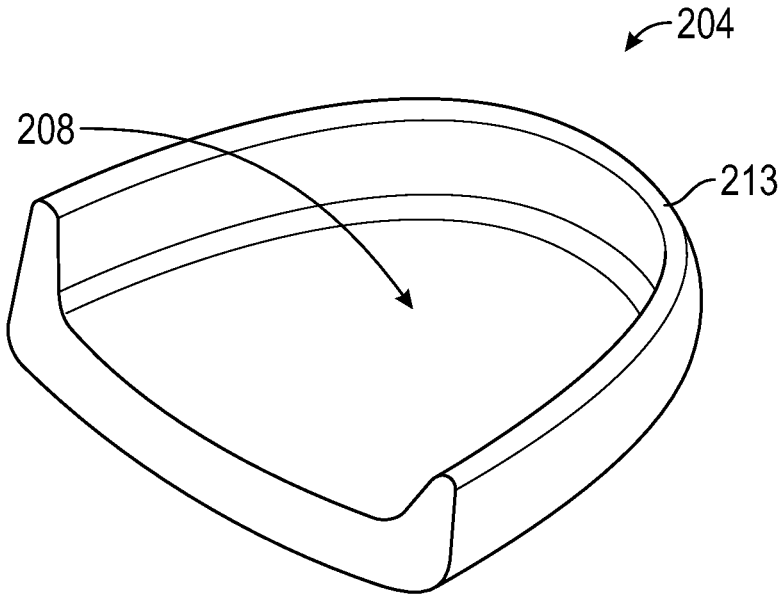
FIG. 19 is a perspective view of the toe adjustment block of FIG. 18 showing a side configured to conform to the article of footwear.

FIG. 18 shows one way in which the article of footwear 10 may be registered to the last 200. Specifically, the article of footwear 10 may be registered to the last 200 by fitting a toe adjustment block 204 to the toe region 25 of the integrally-knitted footwear upper 12 and sole 14. A hand 206 (shown in phantom) presses the toe adjustment block 204 against the sole 14 and around the front of the toc region 25. As shown in FIG. 19, the toc adjustment block 204 has a concavity 208 defined in part by a peripheral flange 213 partially surrounding the toe adjustment block 204. The concavity 208 and peripheral flange 213 are shaped to match the contours of the toe region 25 of the article of footwear 10 when properly positioned on the last 200. By pressing, and slightly sliding and wiggling the toe adjustment block 204 into a most conforming position against the sole 14 and upper 12 on the last 200, the sole 14 and toe box 38 of the upper 12 are properly situated on the last 200 to ensure that only desired areas of the sole 14 and toe box 38 are subjected to the subsequent thermoforming steps described herein.

Figure 20:
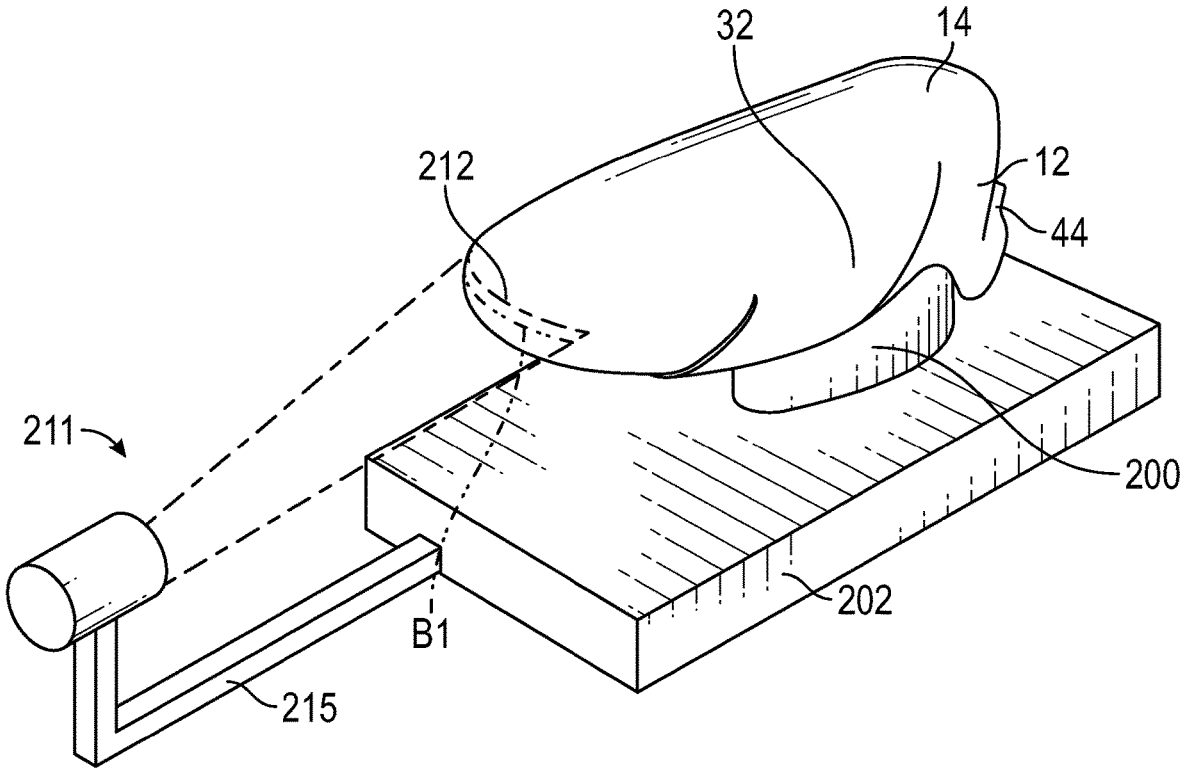
FIG. 20 is a perspective view on of the article of footwear on the last of FIG. 17 with a laser system projecting a laser marking onto the article of footwear to aid in adjusting the position of the article of footwear on the last.

FIG. 20 shows another way of registering the integrally-knitted footwear upper 12 and sole 14 to the last 200 that may be used as an alternative to or in addition to registering using the toe adjustment block 204. Specifically, a laser system 211 is fixedly positioned relative to the last 200, such as by fixedly mounting the laser system 211 relative to the base 202 with a mount 215. Because the last 200 is also fixed to the base 202, the laser system 211 projects a laser marking 212 at a predetermined position at the last 200. The laser marking 212 is a beam of light arranged to fall as a line on the last 200 and on the article of footwear 10 when the article of footwear 10 is mounted on the last 200. When the sole 14 and upper 12 are properly positioned on the last 200, the laser marking 212 coincides with the boundary B1 between the knitted yarns of the sole 14 and the knitted yarns of the toe box 38. The yarns of the sole 14 may be a different color than those of the toe box 38 so that the boundary B1 is readily apparent, and the operator can easily manipulate the position of the article of footwear 10 on the last 200 to align the boundary B1 with the laser marking 212. In FIG. 20, the boundary B1 is shown slightly below the laser marking 212 for purposes of illustration. The operator would properly register the article of footwear 10 on the last 200 by adjusting the article of footwear 10 so that the boundary B1 shifts upward in FIG. 20 to align with the laser marking 212 in FIG. 20.

Figure 21:
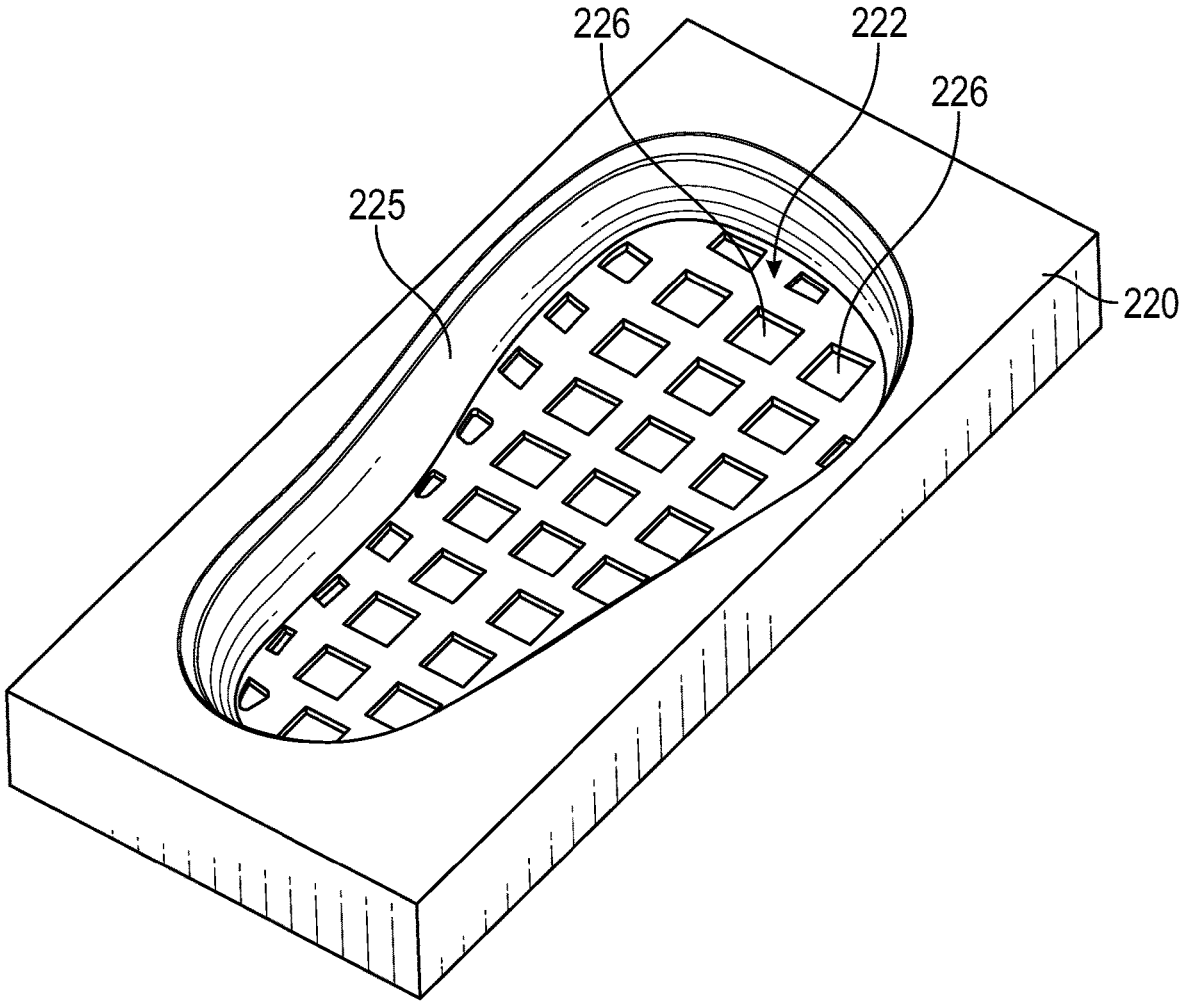
FIG. 21 is a perspective view of a mold of a first heat press used to thermally process the sole of the article of footwear.

FIG. 21 shows a mold 220 used during a heat press process to thermoform the grip yarns of the sole 14. The heat press process is also referred to herein as a thermoforming process. The mold 220 includes a mold cavity 222 to which the sole 14 conforms when subjected to heat and pressure using the heat press 224 of FIG. 22. Because the mold 220 includes the recessed mold cavity 222 having a peripheral sidewall 225, the resulting sole 14 with reflowed polymeric material extends upward at the front of the toe region 25, the rear of the heel region 24, and along the lateral and medial sides 26, 28, as indicated by the position of the boundary B1 in FIGS. 1 and 2, for example. The bottom of the mold cavity 222 includes spaced recesses 226 configured to result in the traction features 102 of the sole 14 when the grip yarns 104, 110 of the sole reflow during the heat pressing process.

Figure 22:
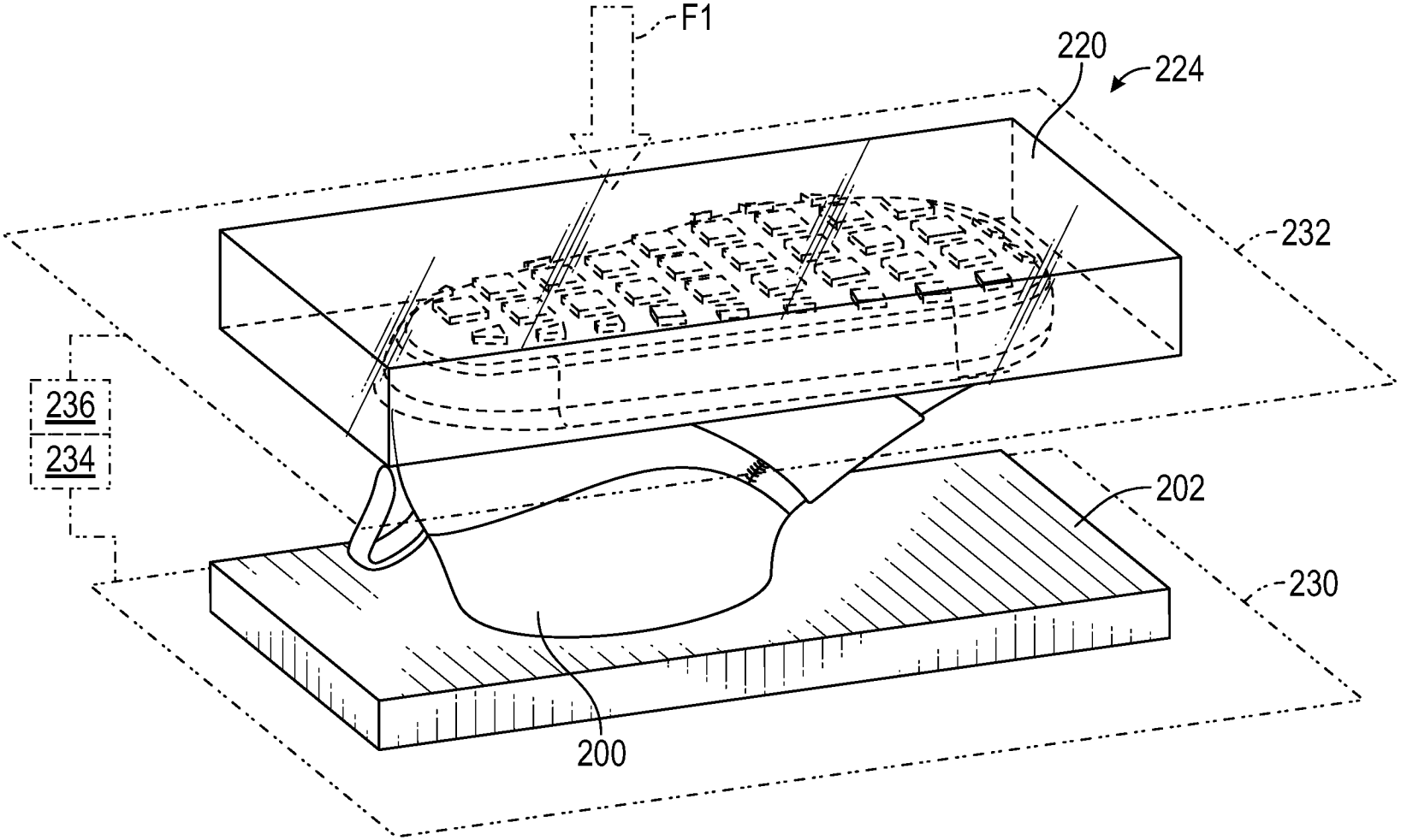
FIG. 22 is a perspective view of the first heat press with the article of footwear on the last of FIG. 17 and mounted on a base of the first heat press during a heat pressing operation using the mold of FIG. 21 to thermally process the sole.

The heat press 224 is shown only schematically with phantom lines in FIG. 22. The heat press 224 may be referred to herein as a first heat press. The base 202 is secured to a first portion 230 of the heat press 224 (also referred to as a lower portion) and the mold 220 is secured to a second portion 232 (also referred to as an upper portion). A controller 234 is programmed to control an actuator 236 that causes movement of the second portion 232 towards the first portion 230 to a molding position shown, as well as controlling a pressing force F1 of the actuator 236, a temperature range of the mold 220, and a duration of holding the second portion 232 in the molding position to carry out a heat pressing schedule that results in thermoforming of the sole 14. Stated differently, the second portion 232 of the heat press provides a temperature sufficient to melt at least a portion of the grip yarn(s) of the sole 14.

Figure 23:
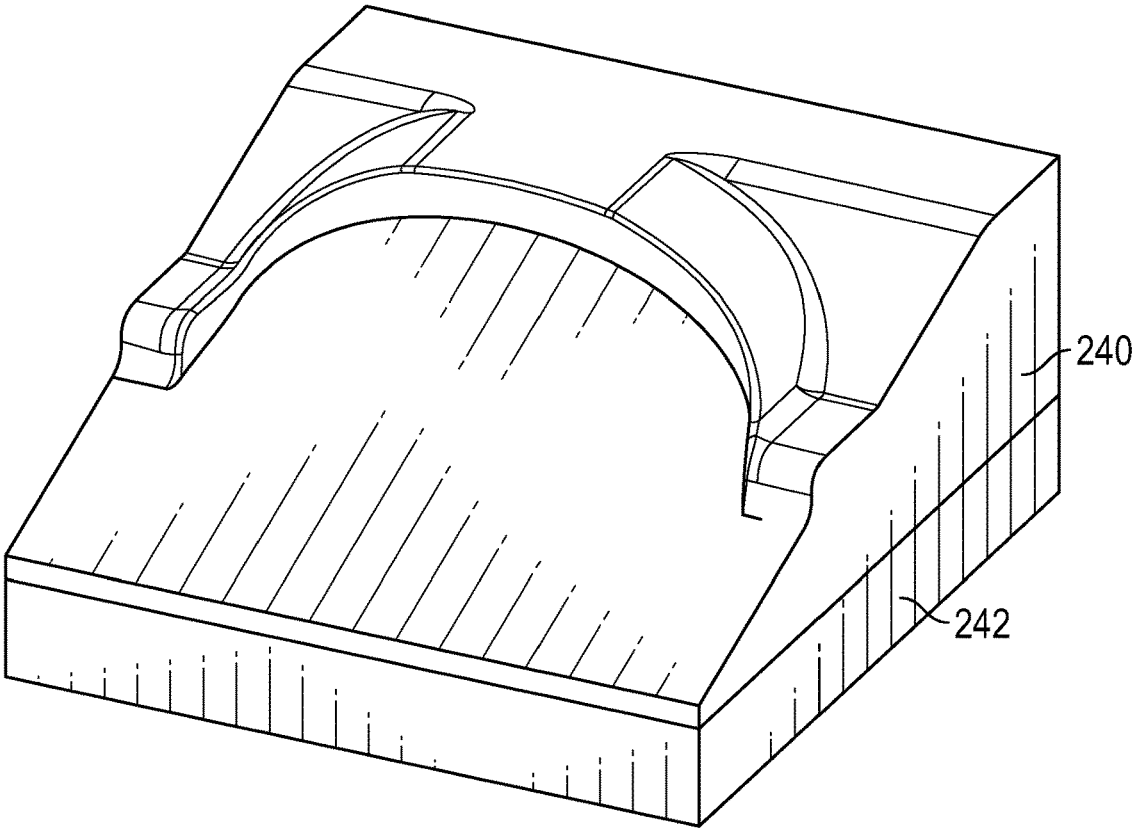
FIG. 23 is a perspective view of a base for the article of footwear on which the forefoot region rests during a toe box thermal processing operation.

Once the sole 14 is heat pressed, a second heat pressing operation may be carried out to thermally process the grip yarn of the lower portion 88 of the toe box 38 of the article of footwear 10, forming the reinforcing skin 91. FIG. 23 is a perspective view of a support 240 mounted on a base 242. During heat pressing of the toe box 38, the forefoot region 20 of the sole 14 rests on the support 240, as shown in FIG. 25.

Figure 24:
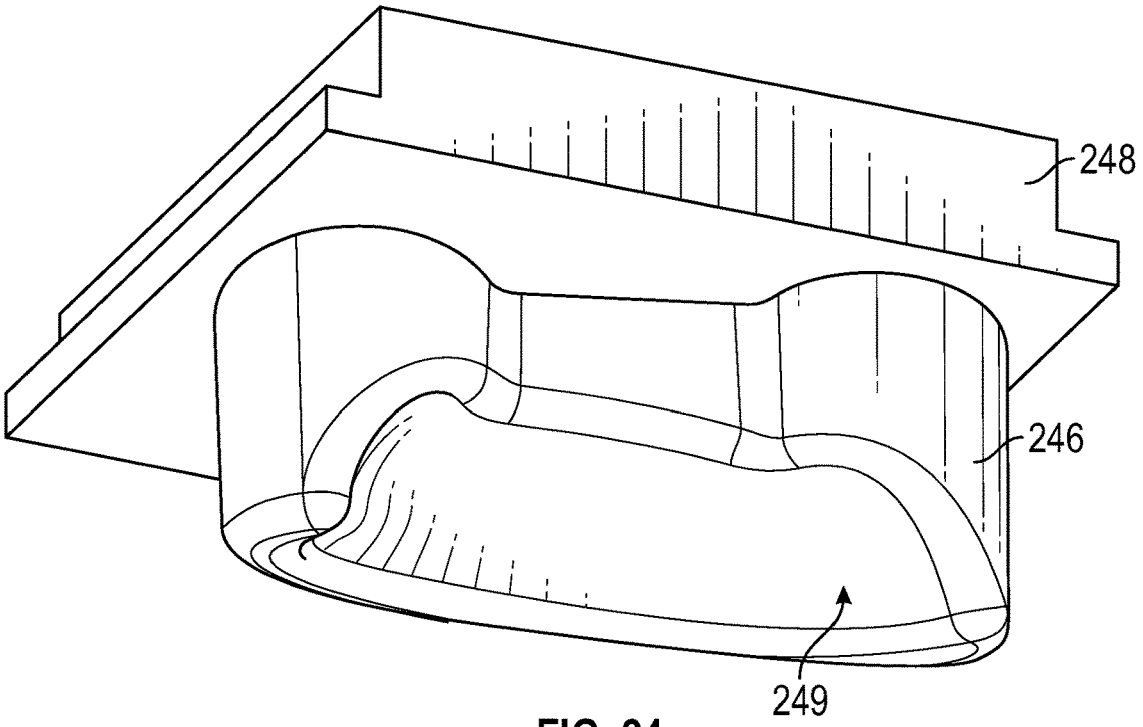
FIG. 24 is a perspective view of a mold used to thermally process the toe box of the article of footwear.

FIG. 24 is a perspective view of a toe box mold 246 mounted to another base 248. The mold 246 includes a mold cavity 249 to which the lower portion 88 of the toe box 38 conforms when subjected to heat and pressure using the heat press 250 of FIG. 25. The toe box heat press 250 is also referred to as a second heat press. Although discussed herein as occurring subsequent to heat pressing of the sole 14, the heat pressing of the toe box 38 may instead occur prior to heat pressing of the sole 14.

Figure 25:
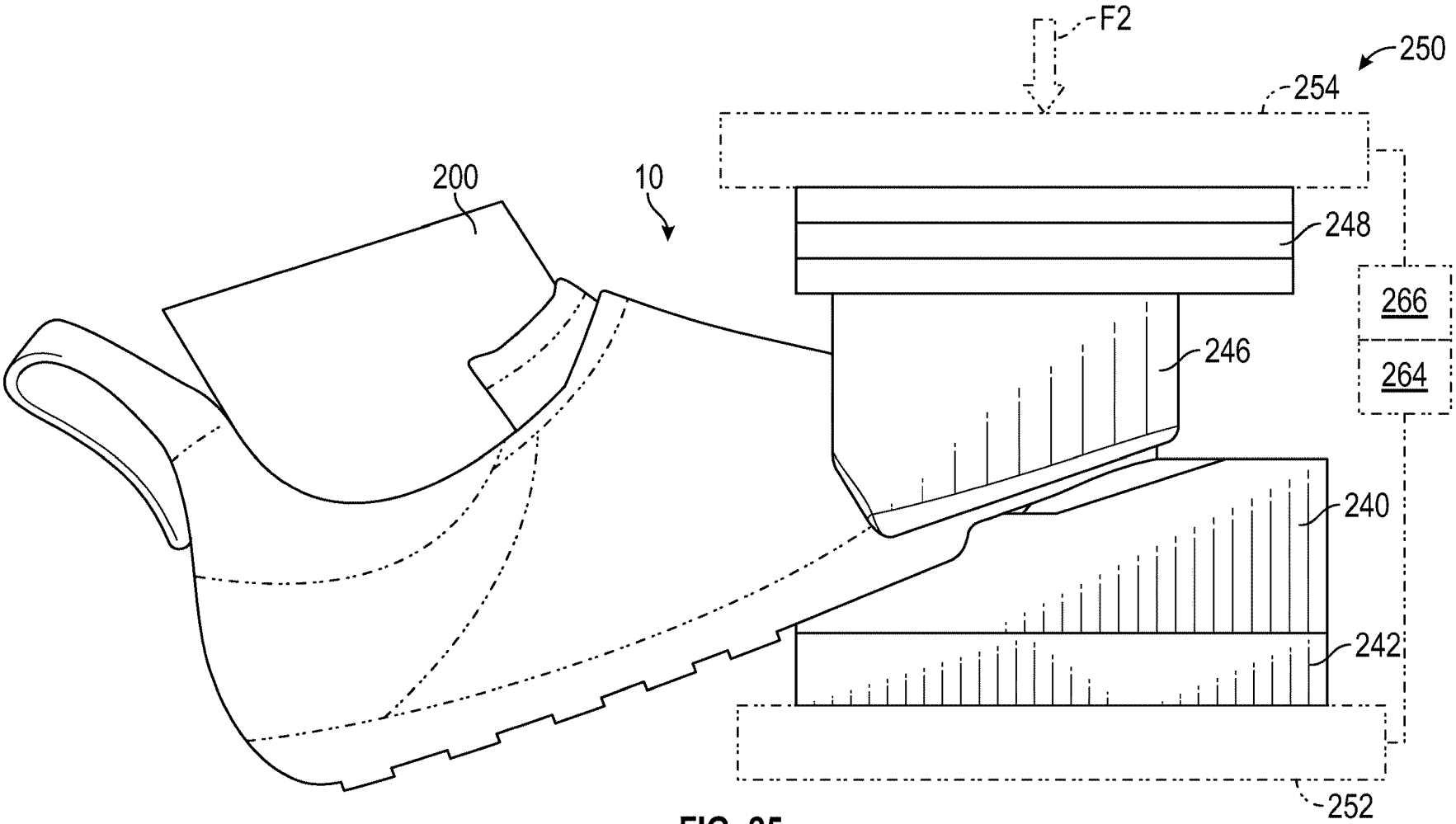
FIG. 25 is a lateral side view of the article of footwear showing a second heat press using base and mold of FIGS. 23-24 during thermal processing of the toe box.

FIG. 25 is a lateral side view of the article of footwear 10 mounted on the last 200 during a second heat pressing operation. The second heat pressing operation is also referred to herein as thermoforming of the toe box 38. The second heat pressing operation uses the support 240 and mold 246 of FIGS. 23-24. A toe box heat press 250 is shown only schematically with phantom lines in FIG. 25. The toe box heat press 250 may be referred to herein as a second heat press. The base 242 is mounted on a first portion 252 of the heat press 250 (also referred to as a lower portion) and the base 248 is mounted to a second portion 254 (also referred to as an upper portion). A controller 264 is programmed to control an actuator 266 that causes movement of the second portion 254 towards the first portion 252 to a molding position shown, as well as to control a pressing force F2, a temperature range of the mold 246, and a duration of holding the second portion 254 in the molding position to carry out a heat pressing schedule that results in thermoforming of the lower portion 88 of the toe box 38. Stated differently, the second portion 254 of the heat press 250 provides a temperature sufficient to melt a portion of the grip yarn(s) of the toe box 38. Specifically, the grip yarn that may be knitted with the elastomeric yarn of the toe box 38 as described herein is thermoformed to forming the reinforcing skin 91 at the lower portion 88 of the knitted toe box 38 adjacent to the sole 14.

Figure 26:
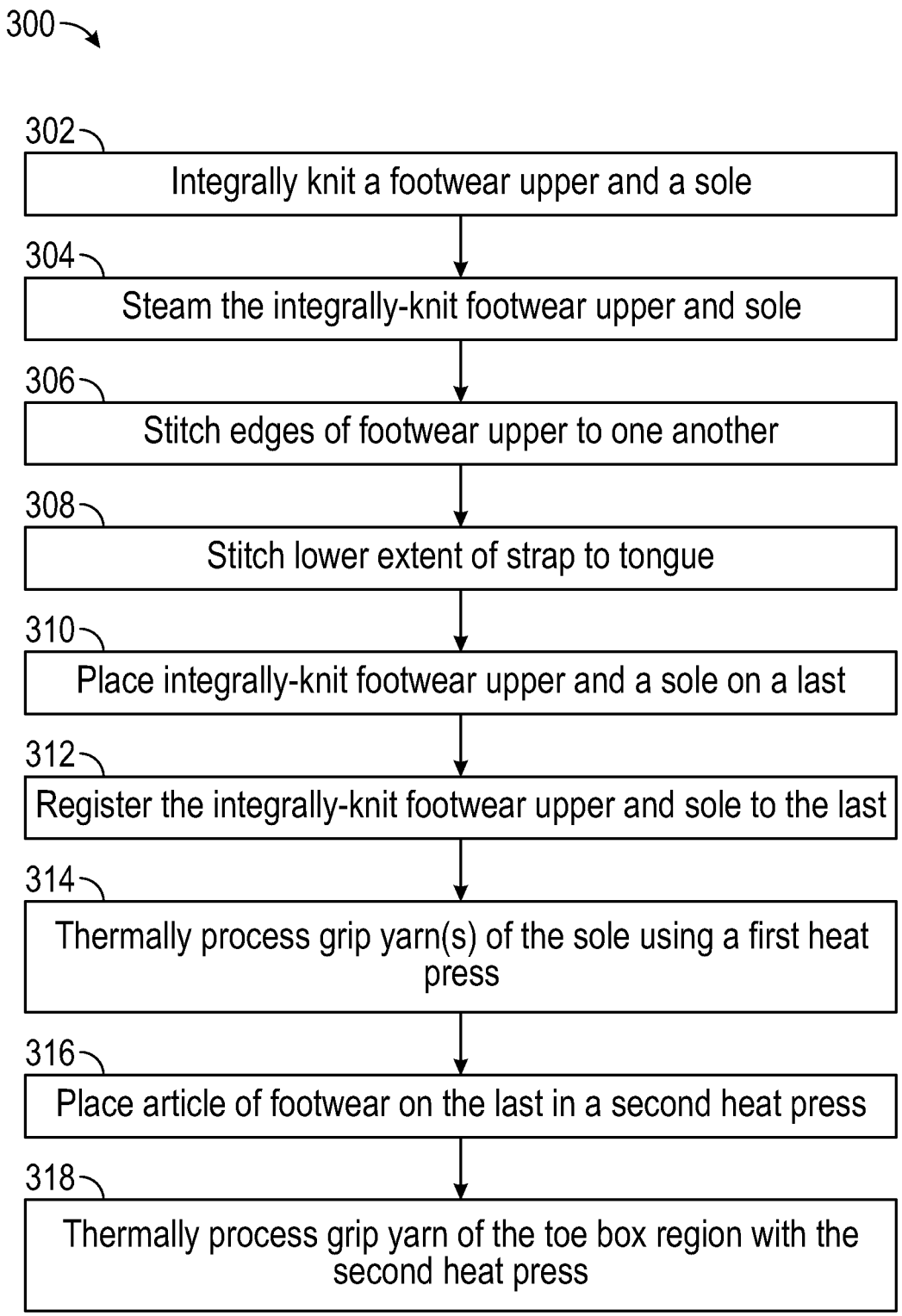
FIG. 26 is a flowchart of a method of manufacturing the article of footwear of FIG. 1.

FIG. 26 is a flow diagram of an example method 300 used to manufacture the article of footwear 10. The method begins with step 302, integrally knitting the footwear upper 12 and the sole 14 of the article of footwear 10 using the various yarns discussed herein, including the one or more grip yarns of the sole 14.

Following step 302, the method 300 may proceed to step 304, steaming the integrally-knitted footwear upper 12 and sole 14. Steaming may be on a jig or otherwise, and may be according to a temperature and duration sufficient to activate and thermally process any fusible yarns of the medial quarter 30, the lateral quarter 32, the heel portion 35, and the tongue 34, such as the yarn 136 described herein, for example, but lower than a temperature at which melting will occur of any grip yarns used to form the sole 14 (such as grip yarns 104 and 110, for example) and lower than a temperature at which any grip yarn of the toe box 38 reflows to form skin 91 of the toc box 38.

Steaming in step 304 alleviates any wrinkles by stiffening the medial quarter 30, the lateral quarter 32, the heel portion 35, and the tongue 34 with the fusible yarn or yarns therein, in preparation for the next step 306, stitching edges of the footwear upper 12 to one another to form the foot-receiving cavity 46. More specifically, stitching of the edge 50 of the tongue 34 to the edge 51 of the medial quarter 30 is carried out with stitches 80 in step 306.

Following step 306, the lower extent of the strap 60 may be stitched to the tongue 34 in step 308 with the reinforcing box stitch 84 to reinforce the strap 60 and to properly align the strap 60 to lay flat over the tongue 34 in the secured position.

Next, the method 300 may proceed to step 310, placing the article of footwear 10 on the last 200 so that the last 200 is within the foot-receiving cavity 46. The last 200 is configured to have a "one-to-one" fit with the article of footwear 10. Stated differently, when the article of footwear 10 is placed on the last 200 and the strap 60 is secured with the fastener portions 66, 70, the last 200 completely fills the foot-receiving cavity 46 so that the article of footwear 10 is snugly fit to the last 200.

To ensure that the article of footwear 10 is properly positioned on the last 200 prior to the heat pressing operation (s) discussed herein, the method 300 may proceed to step 312, registering the integrally-knitted footwear upper 12 and sole 14 to the last 200. One or more different ways of registering the article of footwear 10 may be implemented. For example, the toe adjustment block 204 may be implemented as discussed with respect to FIGS. 18-19. Alternatively or in addition, the laser system 211 may be implemented, as discussed with respect to FIG. 20.

Once the article of footwear 10 is properly registered on the last 200, the method 300 may move to step 314, thermally processing the grip yarn(s) of the sole 14 using the first heat press 224 to form the ground contact surface 16 of the sole 14, including the traction features 102. As discussed, one or more grip yarns may be included in the sole 14. When the grip yarn 104 is used, thermally processing the grip yarn(s) in step 314 includes melting the sheath 124 to form at least a portion of the ground contact surface 16. The additional grip yarn 110 that may also be included in the sole 14 also melts in step 314 and reflows with the thermoplastic material 106 of the sheath 124 to partially form the ground contact surface 16.

Following step 314, the article of footwear 10 on the last 200 is removed from the first heat press 224 and secured in the second heat press 250 in step 316, in preparation for step 318, thermally processing the grip knit yarn included in the lower portion 88 of the toe box 38 with the second heat press 250 to form the reinforcing skin 91.

Figure 27:
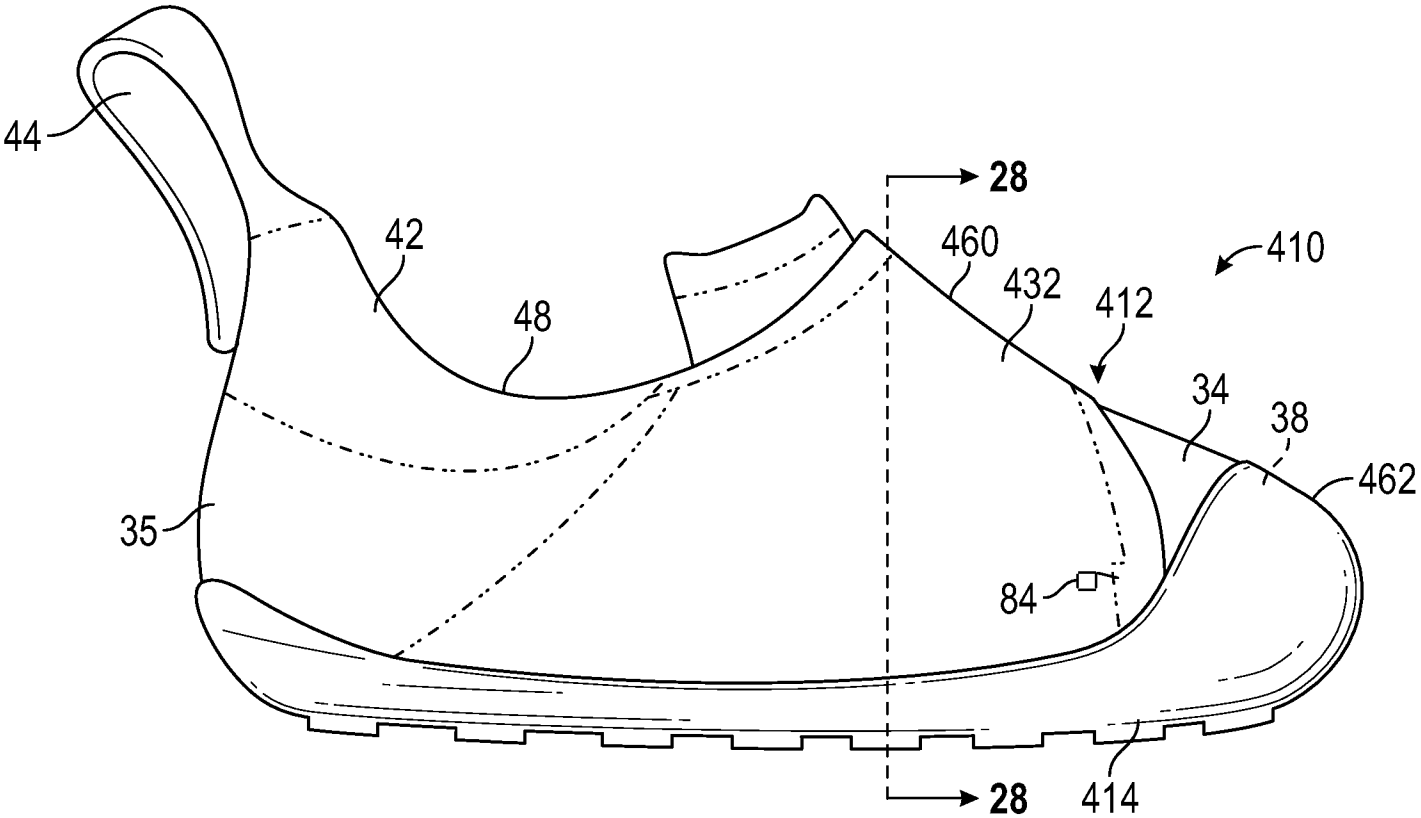
FIG. 27 is a lateral side view of an alternative embodiment of an article of footwear.
Figure 28:
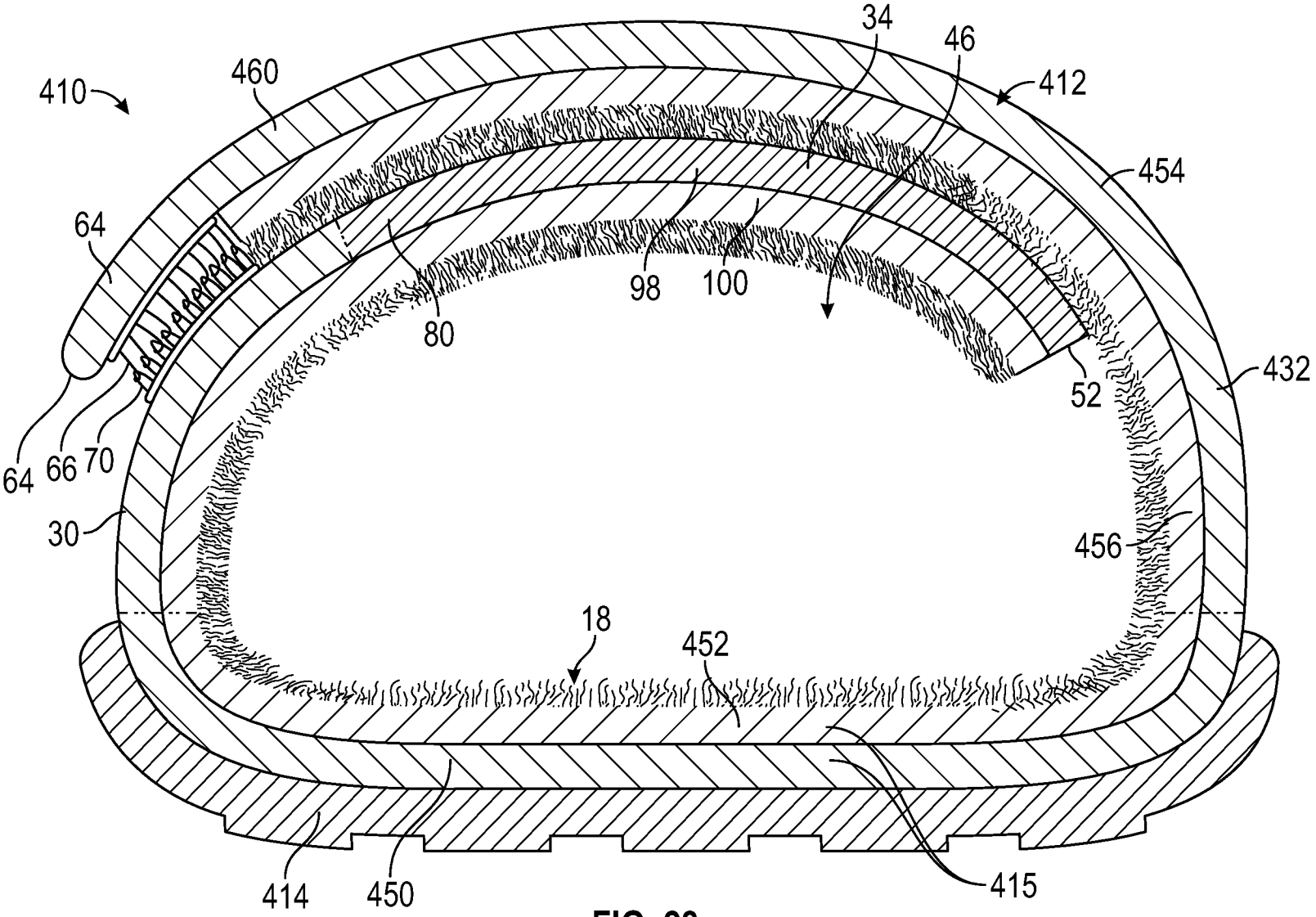
FIG. 28 is a cross-sectional view of the article of footwear of FIG. 27 taken at lines 28-28 in FIG. 27.

FIGS. 27-28 show an alternative embodiment of an article of footwear 410 within the scope of the present teachings. The article of footwear 410 has many of the same features as the article of footwear 10, and these are denoted with the same reference numbers, and the description with respect to the article of footwear 10 applies equally to the article of footwear 410.

One notable difference between the article of footwear 10 and the article of footwear 410 is that the article of footwear 410 has an upper 412 with a knit underfoot portion 415 to which a separate sole 414 is secured. Stated differently, the article of footwear 410 does not include a sole that includes thermally processed grip yarns as does the article of footwear 10. Instead, the medial quarter 30 of the article of footwear and a lateral quarter 432 of the article of footwear 410 extend to and are integrally knitted with the underfoot portion 415. Similarly, the heel portion 35 and the toe box 38 extend to and are integrally knitted with the underfoot portion 415. The underfoot portion 415 includes an outer layer 450 and an inner layer 452. The inner layer defines the foot-contact surface 18.

The lateral quarter 432 of the article of footwear 410 is the same as the lateral quarter 32 of the article of footwear 10 except that, in addition to including the same yarns as described with respect to the lateral quarter 32 in an outer layer 454, the lateral quarter 432 further includes an inner layer 456 that may include the same yarns as the inner layer 452 of the underfoot portion 415. Accordingly, the same yarns of the inner layer 96 of the medial quarter 30, the inner layer 100 of the tongue 34, and the inner layer 452 of the underfoot portion 415 also extend along the inner layer 456 of the lateral quarter 432 and the strap 460 defined by the lateral quarter 432. For example, the yarn(s) of the inner layer 456 may be chenille. A strap 460 of the article of footwear is a portion of the lateral quarter 432 and is the only strap included in the article of footwear 410 securing a foot within the foot-receiving cavity 46. The knitted lateral quarter 432 extends from the toe region 25 of the article of footwear 410 to the knitted heel portion 35 and tapers in width to a distal end 64 of the strap 460.

Accordingly, the method of manufacturing the article of footwear 410 may be the same as the method 300 described with respect to the article of footwear 10 except that, because there is no sole with grip yarns or other fusible yarns, there is no heat pressing operation or other thermal operation to thermally process any grip yarns of a sole. A heat pressing operation to thermally process the lower portion 88 of the toe box 38 may be performed such as to provide a film or skin, such as skin 91 described herein). Alternatively or in addition, the sole 414 may extend sufficiently upward over the lower portion 88 such that no thermal processing to provide a skin 91 may be needed. For example, in FIG. 27, the sole 414 extends upward to form a toecap 462 that covers the toe box 38. Accordingly, instead of the step 314 of thermally processing a sole, the method of manufacturing the article of footwear 410 may include, in addition to some or all of the other steps of the method 300, a step of securing the sole 414 to the underfoot portion 415.

This may be via thermal bonding, adhesive, or both. In either instance, the skin 91 or the toe cap 462 may extend over a lower portion of the tongue 34, the medial quarter 30, and the lateral quarter 432, including a portion of any stitching or seam joining the medial quarter 30 and the tongue 34 or joining the lower end of the lateral quarter 432 and the tongue 34. As such, the skin 91 and/or the toe cap 462 reinforces these portions as well as reinforces the stitching or seams joining these portions.

The following Clauses provide example configurations of an article of footwear and a method of manufacturing an article of footwear disclosed herein.

Clause 1. An article of footwear comprising: an integrally-knitted footwear upper and sole, the sole including a grip yarn.

Clause 2. The article of footwear of clause 1, wherein: the grip yarn includes yarn comprising a first polymeric component and a second polymeric component; and the second polymeric component is configured to reflow when thermoformed.

Clause 3. The article of footwear of clause 1, wherein the first polymeric component and the second polymeric component have different melting temperatures.

Clause 4. The article of footwear of clause 1, wherein the sole includes reflowed polymeric material of the grip yarn.

Clause 5. The article of footwear of clause 4, wherein a ground contact surface of the sole includes the reflowed polymeric material.

Clause 6. The article of footwear of any of clauses 1-5, wherein the grip yarn includes a core and a sheath, and the sheath includes thermoplastic material.

Clause 7. The article of footwear of any of clauses 1-5, wherein: the grip yarn of the sole is a first grip yarn; the sole further includes a reflowed polymeric material of a second grip yarn.

Clause 8. The article of footwear of clause 7, wherein a ground contact surface of the sole includes a polymeric composition that includes reflowed polymeric material of the first grip yarn and reflowed polymeric material of the second grip yarn.

Clause 9. The article of footwear of any of clauses 1-5, wherein: the footwear upper includes a fusible yarn; and the fusible yarn of the footwear upper has a deformation temperature that is lower than a melting temperature of the grip yarn of the sole.

Clause 10. The article of footwear of any of clauses 1-5, wherein: wherein the sole includes reflowed polymeric material of the grip yarn; the reflowed polymeric material is at an outer layer of the sole; the sole further includes an inner layer integrally knit with the outer layer; and the inner layer includes a yarn different than the grip yarn and establishes a footbed having a foot contact surface.

Clause 11. The article of footwear of clause 10, wherein the yarn of the inner layer establishing the footbed includes two or more twisted core yarns with cut pile yarns between the twisted core yarns.

Clause 12. The article of footwear of any of clauses 1-5, wherein the footwear upper includes: a knitted medial quarter at a medial side of the article of footwear; a knitted lateral quarter at a lateral side of the article of footwear; a knitted tongue secured to the knitted medial quarter; and a knitted heel portion extending between the knitted medial quarter and the knitted lateral quarter at a rear of the article of footwear; wherein the sole and the footwear upper together define a foot-receiving cavity; wherein the knitted medial quarter, the knitted lateral quarter, the knitted tongue, and the knitted heel portion together define an ankle opening at the foot-receiving cavity; and wherein the knitted lateral quarter extends to form a strap configured to cross over the knitted tongue and secure at the knitted medial quarter to secure a foot within the foot-receiving cavity.

Clause 13. The article of footwear of clause 12, wherein the strap is the only strap included in the article of footwear securing a foot within the foot-receiving cavity.

Clause 14. The article of footwear of clause 12, wherein the knitted lateral quarter extends from a toe region of the article of footwear to the knitted heel portion and tapers in width to a distal end of the strap.

Clause 15. The article of footwear of clause 12, wherein the knitted tongue has a medial edge extending from a toe region of the article of footwear to the ankle opening at the medial side and stitched to the knitted medial quarter from the toe region at least partway to the ankle opening, and has a lateral edge extending from the toe region to the ankle opening at the lateral side, the knitted tongue and the knitted lateral quarter unstitched and separable from one another at the lateral edge to expand the ankle opening to ease entry into the foot-receiving cavity.

Clause 16. The article of footwear of clause 12, wherein the knitted medial quarter, the knitted tongue, and the knitted lateral quarter each include at least a first yarn comprising at least a first material knitted with a second yarn comprising at least a second material different than the first material, the first yarn and the second yarn each having a deformation temperature that is lower than a melting temperature of the grip yarn of the sole.

Clause 17. The article of footwear of clause 16, wherein the first yarn is at an outer surface of the footwear upper.

Clause 18. The article of footwear of clause 16, wherein the first yarn and the second yarn are at an outer layer of the knitted tongue, and the knitted tongue further includes an inner layer integrally knit with the outer layer, the inner layer including a third yarn comprising at least a third material different than the first material and the second material.

Clause 19. The article of footwear of clause 18, wherein the third yarn includes two or more twisted core yarns with cut pile yarns between the twisted core yarns.

Clause 20. The article of footwear of clause 16, wherein the first yarn and the second yarn are at an outer layer of the knitted medial quarter, and the knitted medial quarter further includes an inner layer integrally knit with the outer layer, the inner layer including a third yarn comprising at least a third material different than the first material and the second material.

Clause 21. The article of footwear of clause 20, wherein the third yarn includes two or more twisted core yarns with cut pile yarns between the twisted core yarns.

Clause 22. The article of footwear of clause 16, wherein the first yarn and the second yarn are at an outer layer of the knitted lateral quarter, and at least the strap of the knitted lateral quarter further includes an inner layer integrally knit with the outer layer, the inner layer including a third yarn comprising at least a third material different than the first material and the second material.

Clause 23. The article of footwear of clause 22, wherein the third yarn includes two or more twisted core yarns with cut pile yarns between the twisted core yarns.

Clause 24. The article of footwear of clause 16, wherein the footwear upper has a knitted toe box forward of the knitted tongue, the knitted toe box including an elastomeric yarn adjacent to a forward extent of the knitted tongue.

Clause 25. The article of footwear of clause 24, wherein the knitted toe box further includes a reflowed polymeric material of an additional grip yarn knitted with the elastomeric yarn and forming a reinforcing skin at a lower portion of the knitted toe box adjacent to the sole.

Clause 26. The article of footwear of clause 25, wherein: the additional grip yarn includes yarn comprising a first polymeric component and a second polymeric component; and the second polymeric component is configured to reflow when thermoformed.

Clause 27. The article of footwear of clause 24, wherein a lower extent of a forward edge of the knitted lateral quarter includes the elastomeric yarn extending contiguously from the knitted toe box.

Clause 28. The article of footwear of clause 27, further comprising: a reinforcing box stitch extending through the strap and the tongue at the lower extent of the forward edge of the strap.

Clause 29. The article of footwear of clause 12, wherein the footwear upper further includes: a knitted collar extending along the knitted medial quarter, along the knitted lateral quarter, and along the knitted heel portion at the ankle opening; and the knitted collar includes an elastomeric yarn.

Clause 30. The article of footwear of clause 12, wherein the footwear upper further includes: a knitted heel pull extending from the knitted heel portion; and the knitted heel pull includes an elastomeric yarn.

Clause 31. A method of manufacturing an article of footwear, the method of manufacturing comprising: integrally knitting a footwear upper and a sole of an article of footwear, the sole including a grip yarn; and thermoforming the grip yarn such that the sole includes reflowed polymeric material of the grip yarn.

Clause 32. The method of clause 31, wherein: the grip yarn includes yarn comprising a first polymeric component and a second polymeric component; and the second polymeric component is configured to reflow when thermoformed.

Clause 33. The method of clause 32, wherein the reflowed polymeric material of the grip yarn forms at least a portion of a ground contact surface of the sole.

Clause 34. The method of manufacturing of any of clauses 32-33, wherein the grip yarn includes a core and a sheath, the sheath including a thermoplastic material, and wherein thermoforming the grip yarn includes melting the sheath such that the reflowed polymeric material of the grip yarn includes the thermoplastic material of the sheath.

Clause 35. The method of manufacturing of any of clauses 32-33, further comprising: prior to thermoforming the grip yarn, stitching edges of the footwear upper to one another to form a foot-receiving cavity; after stitching the edges of the footwear upper to one another, placing the article of footwear on a last with the last within the foot-receiving cavity; and wherein thermoforming the grip yarn includes heating the sole with a heat press having a temperature sufficient to melt at least a portion of the grip yarn.

Clause 36. The method of manufacturing of clause 35, further comprising: prior to stitching the edges of the footwear upper to one another to form a foot-receiving cavity: steaming the integrally-knitted footwear upper and sole.

Clause 37. The method of manufacturing of clause 36, further comprising: after stitching the edges of the footwear upper to one another to form the foot-receiving cavity: placing the integrally-knitted footwear upper and sole on a last; and registering the integrally-knitted footwear upper and sole to the last.

Clause 38. The method of manufacturing of clause 37, wherein registering the integrally-knitted footwear upper and sole to the last includes fitting a toe adjustment block to a toe region of the integrally-knitted footwear upper and sole.

Clause 39. The method of manufacturing of clause 37, wherein registering the integrally-knitted footwear upper and sole to the last includes projecting a laser marking onto the article of footwear.

Clause 40. The method of manufacturing of any of clauses 32-33, wherein thermoforming the grip yarn of the sole is with a first heat press, and the method further comprising: after thermoforming the grip yarn of the sole: placing the article of footwear on a second heat press; and thermoforming an additional grip yarn in at least a portion of a toe box of the article of footwear with the second heat press.

Clause 41. An article of footwear comprising: an integrally-knitted footwear upper including an underfoot portion and defining a foot-receiving cavity above the underfoot portion; wherein the footwear upper includes: a knitted medial quarter at a medial side of the article of footwear; a knitted lateral quarter at a lateral side of the article of footwear; a knitted tongue secured to the knitted medial quarter; and a knitted heel portion extending between the knitted medial quarter and the knitted lateral quarter at a rear of the article of footwear; and a sole secured to an exterior surface of the underfoot portion; wherein the knitted medial quarter, the knitted lateral quarter, the knitted tongue, and the knitted heel portion together define an ankle opening at the foot-receiving cavity; and wherein the knitted lateral quarter extends to form a strap configured to cross over the knitted tongue and secure at the knitted medial quarter to secure a foot within the foot-receiving cavity.

Clause 42. The article of footwear of clause 41, wherein the strap is the only strap included in the article of footwear securing a foot within the foot-receiving cavity.

Clause 43. The article of footwear of any of clauses 41-42, wherein the knitted lateral quarter extends from a toe region of the article of footwear to the knitted heel portion and tapers in width to a distal end of the strap.

Clause 44. The article of footwear of any of clauses 41-42, wherein the knitted tongue has a medial edge extending from a toe region of the article of footwear to the ankle opening at the medial side and stitched to the knitted medial quarter from the toe region at least partway to the ankle opening, and has a lateral edge extending from the toe region to the ankle opening at the lateral side, the knitted tongue and the knitted lateral quarter unstitched and separable from one another at the lateral edge to expand the ankle opening to ease entry into the foot-receiving cavity.

Clause 45. The article of footwear of any of clauses 41-42, wherein the knitted medial quarter, the knitted tongue, and the knitted lateral quarter each include at least a first yarn comprising at least a first material knitted with a second yarn comprising a at least a second material different than the first material.

Clause 46. The article of footwear of clause 45, wherein the first yarn is at an outer surface of the footwear upper.

Clause 47. The article of footwear of clause 45, wherein the first yarn and the second yarn are at an outer layer of the knitted tongue, and the knitted tongue further includes an inner layer integrally knit with the outer layer, the inner layer including a third yarn comprising at least a third material different than the first material and the second material.

Clause 48. The article of footwear of clause 47, wherein the third yarn includes two or more twisted core yarns with cut pile yarns between the twisted core yarns.

Clause 49. The article of footwear of clause 45, wherein the first yarn and the second yarn are at an outer layer of the knitted medial quarter, and the knitted medial quarter further includes an inner layer integrally knit with the outer layer, the inner layer including a third yarn comprising at least a third material different than the first material and the second material.

Clause 50. The article of footwear of clause 49, wherein the third yarn includes two or more twisted core yarns with cut pile yarns between the twisted core yarns.

Clause 51. The article of footwear of clause 45, wherein the first yarn and the second yarn are at an outer layer of the knitted lateral quarter, and at least the strap of the knitted lateral quarter further includes an inner layer integrally knit with the outer layer, the inner layer including a third yarn comprising at least a third material different than the first material and the second material.

Clause 52. The article of footwear of clause 51, wherein the third yarn includes two or more twisted core yarns with cut pile yarns between the twisted core yarns.

Clause 53. The article of footwear of any of clauses 41-42, wherein the footwear upper has a knitted toe box forward of the knitted tongue, the knitted toe box including an elastomeric yarn adjacent to a forward extent of the knitted tongue.

Clause 54. The article of footwear of clause 53, wherein the knitted toe box further includes a grip yarn knitted with the elastomeric yarn and forming a reinforcing skin at a lower portion of the knitted toe box adjacent to the sole.

Clause 55. The article of footwear of clause 54, wherein: the grip yarn includes yarn comprising a first polymeric component and a second polymeric component; and the second polymeric component is configured to reflow when thermoformed.

Clause 56. The article of footwear of clause 55, wherein the first polymeric component and the second polymeric component have different melting temperatures.

Clause 57. The article of footwear of clause 53, wherein a lower extent of a forward edge of the knitted lateral quarter includes the elastomeric yarn extending contiguously from the knitted toe box.

Clause 58. The article of footwear of any of clauses 41-42, further comprising: a reinforcing box stitch extending through the strap and the tongue at a lower extent of a forward edge of the strap.

Clause 59. The article of footwear of any of clauses 41-42, wherein the footwear upper further includes: a knitted collar extending along the knitted medial quarter, along the knitted lateral quarter, and along the knitted heel portion at the ankle opening; and the knitted collar includes an elastomeric yarn.

Clause 60. The article of footwear of any of clauses 41-42, wherein the footwear upper further includes: a knitted heel pull extending from the knitted heel portion; and the knitted heel pull includes an elastomeric yarn.

Clause 61. An article of footwear, comprising: a knitted component forming one or more of an overfoot portion of the footwear and an underfoot portion of the article of footwear; wherein the underfoot portion comprises an external facing layer forming ground contacting portions and an internal facing layer forming foot contacting portions, the external facing layer including a first material comprising a thermoplastic material and the internal facing layer including a second material different from the first material; wherein one or more portions of the external facing layer including the first material have a different coefficient of friction relative to the internal facing layer including the second material.

Clause 62. The article of footwear of clause 61, wherein the one or more portions of the external facing layer have a greater coefficient of friction relative to the internal facing layer including the second material.

Clause 63. The article of footwear of any of clauses 61-62, wherein the external facing layer further comprises one or more raised traction elements including the first material.

Clause 64. The article of footwear of clause 63, wherein the one or more raised traction elements includes reflowed first material.

Clause 65. The article of footwear of any of clauses 61-62, wherein the external facing layer comprises one or more interlooped yarns, each of the one or more interlooped yarns having a coating of the first material surrounding a core yarn, the core yarn having a second material that excludes the thermoplastic material and has a greater melting temperature than the first material.

Clause 66. The article of footwear of clause 65, wherein the first material is at least partially fused with one or more core yarns.

Clause 67. The article of footwear of clause 65, wherein the internal facing layer comprises one or more second interlooped yarns comprising the second material; and wherein the first material is at least partially fused to a portion of the one or more second interlooped yarns.

Clause 68. The article of footwear of clause 65, wherein one or more intersection portions at or near a junction of the external facing layer and the internal facing layer include the first material.

Clause 69. The article of footwear of any of clauses 61-62, wherein the overfoot portion includes: a knitted medial quarter at a medial side of the article of footwear; a knitted lateral quarter at a lateral side of the article of footwear; a knitted tongue secured to the knitted medial quarter; and a knitted heel portion extending between the knitted medial quarter and the knitted lateral quarter at a rear of the article of footwear; wherein the knitted medial quarter, the knitted lateral quarter, the knitted tongue, and the knitted heel portion together define an ankle opening into a foot-receiving cavity over the underfoot portion; and wherein the knitted lateral quarter extends to form a strap configured to cross over the knitted tongue and secure at the knitted medial quarter to secure a foot within a foot-receiving cavity over the underfoot portion.

Clause 70. The article of footwear of clause 69, wherein the strap is the only strap included in the article of footwear securing a foot within the foot-receiving cavity.

Clause 71. The article of footwear of clause 69, wherein the knitted lateral quarter extends from a toe region of the article of footwear to the knitted heel portion and tapers in width to a distal end of the strap.

Clause 72. The article of footwear of clause 69, wherein the knitted tongue has a medial edge extending from a toe region of the article of footwear to the ankle opening at the medial side and stitched to the knitted medial quarter from the toe region at least partway to the ankle opening, and has a lateral edge extending from the toe region to the ankle opening at the lateral side, the knitted tongue and the knitted lateral quarter unstitched and separable from one another at the lateral edge to expand the ankle opening to case entry into the foot-receiving cavity.

Clause 73. The article of footwear of clause 69, wherein the knitted medial quarter, the knitted tongue, and the knitted lateral quarter each include at least a first yarn comprising at least a first material knitted with a second yarn comprising a at least a second material different than the first material.

Clause 74. The article of footwear of clause 73, wherein the first yarn is at an outer surface of the footwear upper.

Clause 75. The article of footwear of clause 73, wherein the first yarn and the second yarn are at an outer layer of the knitted tongue, and the knitted tongue further includes an inner layer integrally knit with the outer layer, the inner layer including a third yarn comprising at least a third material different than the first material and the second material.

Clause 76. The article of footwear of clause 775, wherein the third yarn includes two or more twisted core yarns with cut pile yarns between the twisted core yarns.

Clause 77. The article of footwear of clause 73, wherein the first yarn and the second yarn are at an outer layer of the knitted medial quarter, and the knitted medial quarter further includes an inner layer integrally knit with the outer layer, the inner layer including a third yarn comprising at least a third material different than the first material and the second material.

Clause 78. The article of footwear of clause 76, wherein the third yarn includes two or more twisted core yarns with cut pile yarns between the twisted core yarns.

Clause 79. The article of footwear of clause 73, wherein the first yarn and the second yarn are at an outer layer of the knitted lateral quarter, and at least the strap of the knitted lateral quarter further includes an inner layer integrally knit with the outer layer, the inner layer including a third yarn comprising at least a third material different than the first material and the second material.

Clause 80. The article of footwear of clause 79, wherein the third yarn includes two or more twisted core yarns with cut pile yarns between the twisted core yarns.

Clause 81. The article of footwear of clause 69, wherein the footwear upper has a knitted toe box forward of the knitted tongue, the knitted toe box including an elastomeric yarn adjacent to a forward extent of the knitted tongue.

Clause 82. The article of footwear of clause 81, wherein the knitted toe box further includes a grip yarn knitted with the elastomeric yarn and forming a reinforcing skin at a lower portion of the knitted toe box adjacent to the sole.

Clause 83. The article of footwear of clause 82, wherein: the grip yarn includes yarn comprising a first polymeric component and a second polymeric component; and the second polymeric component is configured to reflow when thermoformed.

Clause 84. The article of footwear of clause 83, wherein the first polymeric component and the second polymeric component have different melting temperatures.

Clause 85. The article of footwear of clause 81, wherein a lower extent of a forward edge of the knitted lateral quarter includes the elastomeric yarn extending contiguously from the knitted toe box.

Clause 86. The article of footwear of clause 69, further comprising: a reinforcing box stitch extending through the strap and the tongue at a lower extent of a forward edge of the strap.

Clause 87. The article of footwear of clause 69, wherein the footwear upper further includes: a knitted collar extending along the knitted medial quarter, along the knitted lateral quarter, and along the knitted heel portion at the ankle opening; and the knitted collar includes an elastomeric yarn.

Clause 88. The article of footwear of clause 69, wherein the footwear upper further includes: a knitted heel pull extending from the knitted heel portion; and the knitted heel pull includes an elastomeric yarn.

Clause 89. An article of footwear comprising: an integrally-knitted footwear upper and sole, the sole including one or more interlooped yarns comprising a first material, the first material including a thermoplastic material.

Clause 90. The article of footwear of clause 89, wherein the sole includes reflowed polymeric material of the thermoplastic material.

Clause 91. The article of footwear of clause 90, wherein a ground contact surface of the sole includes the reflowed polymeric material.

Clause 92. The article of footwear of any of clauses 89-91, wherein at least one of the one or more interlooped yarns includes a core and a sheath, and the sheath includes the thermoplastic material.

Clause 93. The article of footwear of any of clauses 89-91, wherein: the one or more interlooped yarns comprising the first material is a first yarn, the one or more interlooped yarns include a second yarn comprising a second thermoplastic material, and a ground contact surface of the sole is a polymeric composition of reflowed polymeric material of the first yarn and reflowed polymeric material of the second yarn.

Clause 94. The article of footwear of any of clauses 89-91, wherein: the one or more interlooped yarns comprising the first material are at an outer layer of the sole; the sole further includes an inner layer integrally knit with the outer layer; and the inner layer includes a yarn comprising a different material than the first material and establishes a footbed having a foot contact surface.

Clause 95. The article of footwear of clause 94, wherein a ground contact surface of the sole includes reflowed polymeric material of the thermoplastic material, and one or more portions of the of the ground contact surface including the reflowed polymeric material have a different coefficient of friction relative to the foot contact surface including the yarn of the inner layer.

Clause 96. The article of footwear of clause 94, wherein the yarn of the inner layer establishing the footbed includes two or more twisted core yarns with cut pile yarns between the twisted core yarns.

Clause 97. The article of footwear of any of clauses 89-91, wherein the footwear upper includes: a knitted medial quarter at a medial side of the article of footwear; a knitted lateral quarter at a lateral side of the article of footwear; a knitted tongue secured to the knitted medial quarter; and a knitted heel portion extending between the knitted medial quarter and the knitted lateral quarter at a rear of the article of footwear; wherein the sole and the footwear upper together define a foot-receiving cavity; wherein the knitted medial quarter, the knitted lateral quarter, the knitted tongue, and the knitted heel portion together define an ankle opening at the foot-receiving cavity; and wherein the knitted lateral quarter extends to form a strap configured to cross over the knitted tongue and secure at the knitted medial quarter to secure a foot within the foot-receiving cavity.

Clause 98. The article of footwear of clause 97, wherein the footwear upper has a knitted toe box forward of the knitted tongue, the knitted toe box including an elastomeric yarn adjacent to a forward extent of the knitted tongue.

Clause 99. The article of footwear of clause 98, wherein the knitted toe box further includes a reflowed polymeric material of an additional yarn knitted with the elastomeric yarn and forming a reinforcing skin at a lower portion of the knitted toe box adjacent to the sole.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" particularly refers to a direction extending a length of a component. For example, a longitudinal direction of a shoe extends between a forefoot region and a heel region of the shoe. The term "forward" or "anterior" is used to particularly refer to the general direction from a heel region toward a forefoot region, and the term "rearward" or "posterior" is used to particularly refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" particularly refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" particularly refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" particularly refers to the vertical direction pointing towards a top of the component, which may include an instep, a fastening region and/or a throat of an upper. The term "downward" or "downwards" particularly refers to the vertical direction pointing opposite the upwards direction, toward the bottom of a component and may generally point towards the bottom of a sole structure of an article of footwear.

The "interior" of an article of footwear, such as a shoe, particularly refers to portions at the space that is occupied by a wearer's foot when the shoe is worn. The "inner side" of a component particularly refers to the side or surface of the component that is (or will be) oriented toward the interior of the component or article of footwear in an assembled article of footwear. The "outer side" or "exterior" of a component particularly refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" particularly refer to the direction toward the interior of the component or article of footwear, such as a shoe, and the terms "outward" and "outwardly" particularly refer to the direction toward the exterior of the component or article of footwear, such as the shoe. In addition, the term "proximal" particularly refers to a direction that is nearer a center of a footwear component, or is closer toward a foot when the foot is inserted in the article of footwear as it is worn by a user. Likewise, the term "distal" particularly refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

an integrally-knitted footwear upper including an underfoot portion and defining a foot-receiving cavity above the underfoot portion;

wherein the footwear upper includes:

a knitted medial quarter at a medial side of the article of footwear;

a knitted lateral quarter at a lateral side of the article of footwear;

a knitted tongue secured to the knitted medial quarter; and a knitted heel portion extending between the knitted medial quarter and the knitted lateral quarter at a rear of the article of footwear; and a sole secured to an exterior surface of the underfoot portion;

wherein the knitted medial quarter, the knitted lateral quarter, the knitted tongue, and the knitted heel portion together define an ankle opening at the foot-receiving cavity;

wherein the knitted lateral quarter extends to form a strap configured to cross over the knitted tongue and secure at the knitted medial quarter to secure a foot within the foot-receiving cavity; and wherein the footwear upper is free from connected edges of the underfoot portion, connected edges of the underfoot portion and the knitted medial quarter, and free from connected edges of the underfoot portion and the knitted lateral quarter.

2. The article of footwear of claim 1, wherein the strap is the only strap included in the article of footwear securing a foot within the foot-receiving cavity.

3. The article of footwear of claim 1, wherein the knitted lateral quarter extends from a toe region of the article of footwear to the knitted heel portion and tapers in width to a distal end of the strap.

4. The article of footwear of claim 1, wherein the knitted tongue has a medial edge extending from a toe region of the article of footwear to the ankle opening at the medial side and stitched to the knitted medial quarter from the toe region at least partway to the ankle opening, and has a lateral edge extending from the toe region to the ankle opening at the lateral side, the knitted tongue and the knitted lateral quarter unstitched and separable from one another at the lateral edge to expand the ankle opening to ease entry into the foot-receiving cavity.

5. The article of footwear of claim 1, wherein the knitted medial quarter, the knitted tongue, and the knitted lateral quarter each include at least a first yarn comprising at least a first material knitted with a second yarn comprising at least a second material different than the first material.

6. The article of footwear of claim 5, wherein the first yarn is at an outer surface of the footwear upper.

7. The article of footwear of claim 5, wherein the first yarn and the second yarn are at an outer layer of the knitted tongue, and the knitted tongue further includes an inner layer integrally knit with the outer layer, the inner layer including a third yarn comprising at least a third material different than the first material and the second material.

8. The article of footwear of claim 7, wherein the third yarn includes two or more twisted core yarns with cut pile yarns between the twisted core yarns.

9. The article of footwear of claim 5, wherein the first yarn and the second yarn are at an outer layer of the knitted medial quarter, and the knitted medial quarter further includes an inner layer integrally knit with the outer layer, the inner layer including a third yarn comprising at least a third material different than the first material and the second material.

10. The article of footwear of claim 9, wherein the third yarn includes two or more twisted core yarns with cut pile yarns between the twisted core yarns.

11. The article of footwear of claim 5, wherein the first yarn and the second yarn are at an outer layer of the knitted lateral quarter, and at least the strap of the knitted lateral quarter further includes an inner layer integrally knit with the outer layer, the inner layer including a third yarn comprising at least a third material different than the first material and the second material.

12. The article of footwear of claim 11, wherein the third yarn includes two or more twisted core yarns with cut pile yarns between the twisted core yarns.

13. The article of footwear of claim 1, wherein the footwear upper has a knitted toe box forward of the knitted tongue, the knitted toe box including one or more interlooped yarns comprising a first material, the first material including a thermoplastic material.

14. The article of footwear of claim 13, wherein the knitted toe box includes reflowed polymeric material of the thermoplastic material.

15. The article of footwear of claim 14, wherein:

the one or more interlooped yarns include an elastomeric yarn adjacent a forward extent of the knitted tongue.

16. The article of footwear of claim 15, wherein a lower extent of a forward edge of the knitted lateral quarter includes the elastomeric yarn extending contiguously from the knitted toe box.

17. The article of footwear of claim 1, further comprising:

a reinforcing box stitch extending through the strap and the knitted tongue at a lower extent of a forward edge of the strap.

18. The article of footwear of claim 1, wherein the footwear upper further includes:

a knitted collar extending along the knitted medial quarter, along the knitted lateral quarter, and along the knitted heel portion at the ankle opening; and the knitted collar includes an elastomeric yarn.

19. The article of footwear of claim 1, wherein the footwear upper further includes:

a knitted heel pull extending from the knitted heel portion; and the knitted heel pull includes an elastomeric yarn.

20. An article of footwear comprising:

an integrally-knitted footwear upper including an underfoot portion and defining a foot-receiving cavity above the underfoot portion;

wherein the footwear upper includes:

a knitted medial quarter at a medial side of the article of footwear;

a knitted lateral quarter at a lateral side of the article of footwear;

a knitted tongue secured to the knitted medial quarter; and a knitted heel portion extending between the knitted medial quarter and the knitted lateral quarter at a rear of the article of footwear; and a sole secured to an exterior surface of the underfoot portion;

wherein the knitted medial quarter, the knitted lateral quarter, the knitted tongue, and the knitted heel portion together define an ankle opening at the foot-receiving cavity;

wherein the knitted lateral quarter extends to form a strap configured to cross over the knitted tongue and secure at the knitted medial quarter to secure a foot within the foot-receiving cavity;

wherein the strap tapers in width continuously from a proximal end of the strap to a distal end of the strap; and wherein the footwear upper is free from connected edges of the underfoot portion, connected edges of the underfoot portion and the knitted medial quarter, and free from connected edges of the underfoot portion and the knitted lateral quarter.

* * * * *